US011731156B2

(12) United States Patent
Tani et al.

(10) Patent No.: US 11,731,156 B2
(45) Date of Patent: Aug. 22, 2023

(54) PAINTING SYSTEM AND METHOD OF PAINTING

(71) Applicant: TOYOTA JIDOSHA KABUSHIKI KAISHA, Toyota (JP)

(72) Inventors: Shinji Tani, Miyoshi (JP); Akira Numasato, Nagoya (JP); Kazuki Tanaka, Toyota (JP); Takufumi Kimura, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/368,191

(22) Filed: Jul. 6, 2021

(65) Prior Publication Data

US 2022/0008947 A1 Jan. 13, 2022

(30) Foreign Application Priority Data

Jul. 10, 2020 (JP) ..... 2020-119023

(51) Int. Cl.

*B05B 15/55* (2018.01)
*B05B 5/08* (2006.01)
*B05B 13/04* (2006.01)

(52) U.S. Cl.

CPC ..... *B05B 15/55* (2018.02); *B05B 5/08* (2013.01); *B05B 13/0431* (2013.01)

(58) Field of Classification Search

USPC ..... 118/323, 321, 621–624, 634, 326, 309, 118/302

See application file for complete search history.

(56) References Cited

U.S. PATENT DOCUMENTS 6,179,217 B1 1/2001 Yoshida et al.
6,666,164 B2 * 12/2003 Yoshida ..... B05B 12/1463 118/503
2009/0108109 A1 * 4/2009 Mori ..... B05B 12/1463 239/694
2010/0230511 A1 9/2010 Umezawa et al.
2017/0368579 A1 12/2017 Prus et al.

FOREIGN PATENT DOCUMENTS

JP 2003-093932 A 4/2003
JP 2008-100196 A 5/2008
WO 97/34707 A1 9/1997
WO 2008/096453 A1 8/2008
WO 2017/182604 A1 10/2017

OTHER PUBLICATIONS

English translation of JP2003093932A (Year: 2003).*

* cited by examiner

*Primary Examiner* — Yewebdar T Tadesse
(74) *Attorney, Agent, or Firm* — Sughrue Mion, PLLC

(57) ABSTRACT

A painting system includes painting unit including a first painting robot and a second painting robot, a cartridge carrier, and a cleaning tank. The painting robots each include a robot arm including a painting machine. The cartridge carrier includes a cartridge grip part. A first region is a region where a movable region of the painting machine of the first painting robot overlaps with a movable region of the cartridge grip part. A second region is a region where the movable region of the painting machine of the second painting robot overlaps with the movable region of the cartridge grip part. The cleaning tank is provided in a position including at least a part of the first region and at least a part of the second region.

9 Claims, 11 Drawing Sheets

PAINTING SYSTEM AND METHOD OF PAINTING

CROSS-REFERENCE TO RELATED APPLICATION

This application claims priority to Japanese Patent Application No. 2020-119023 filed on Jul. 10, 2020, incorporated herein by reference in its entirety.

BACKGROUND

1. Technical Field

The present disclosure relates to painting systems that paint an article to be painted, such as a vehicle body of a vehicle, and a method of painting using the painting system. The present disclosure particularly relates to improvement of a painting system including at least two painting robots, and a method of painting thereby.

2. Description of Related Art

A painting system disclosed in Japanese Patent Application Publication No. 2008-100196 (JP 2008-100196 A) is known as a painting system that paints an article to be painted, such as a vehicle body of a vehicle, by spraying an atomized paint toward the article to be painted. The painting system disclosed in JP 2008-100196 A includes a plurality of painting robots disposed along a carrying path of an article to be painted, and operates each of the painting robots to paint the article to be painted. Each of the painting robots includes a robot arm having a spray gun provided at the tip thereof. The spray gun is removably loaded with a paint cartridge. In the case where a residual amount of the paint in the paint cartridge becomes small after the end of painting work with the painting system, or in the case of changing the type (e.g., changing the color) of the paint to be used for painting a next article that is carried into the painting system for painting, the paint cartridge loaded into the spray gun is replaced.

SUMMARY

When replacing a paint cartridge loaded into a spray gun, it is generally necessary to remove the used paint cartridge from the spray gun and then clean the spray gun before loading a paint cartridge injected with paint onto the spray gun.

In conventional painting systems, the painting robots are each configured as an individual unit. Hence, the painting robots are each provided with an individual cleaning tank. When cleaning the spray gun, the robots move their spray guns to their own (individual) cleaning tanks to perform cleaning operation.

In such configuration where the painting robots are provided with their individual cleaning tanks, that is, in the configuration where the installation number of the cleaning tanks is equal to the number of the painting robots, it is difficult to reduce the number of parts count of the painting system, and this leads to increase in production man hours of the painting system or rise in equipment cost.

The present disclosure provides a painting system capable of achieving reduction in the number of parts count, and a method of painting using the painting system.

A painting system according to a first aspect of the present disclosure includes a painting unit, a cartridge carrier, and a single cleaning tank. The painting unit is configured to move relatively to an article to be painted. The painting unit includes a first painting robot and a second painting robot. Each of the first painting robot and the second painting robot includes a robot arm. Each of the robot arms includes a painting machine. The painting machine includes a cartridge loading part and a paint discharge part. The cartridge loading part is configured to be loaded with a paint cartridge. The paint discharge part is configured to discharge paint supplied from the paint cartridge toward the article to be painted. The cartridge carrier is configured to carry the paint cartridge and load the paint cartridge into the cartridge loading part. The cartridge carrier includes a cartridge grip part configured to grip the paint cartridge. The single cleaning tank is configured to clean the paint discharge parts of the painting machines in the first painting robot and in the second painting robot. The first painting robot and the cartridge carrier are disposed such that a movable region of the painting machine of the first painting robot and a movable region of the cartridge grip part each include a first region where the movable region of the painting machine of the first painting robot overlaps with the movable region of the cartridge grip part. The second painting robot and the cartridge carrier are disposed such that a movable region of the painting machine of the second painting robot and the movable region of the cartridge grip part each include a second region where the movable region of the painting machine of the second painting robot overlaps with the movable region of the cartridge grip part. The single cleaning tank is provided in a position including at least a part of the first region and at least a part of the second region.

According to the painting system of the first aspect of the present disclosure, in replacing a paint cartridge loaded into the cartridge loading part of the painting machine in each painting robot, the paint cartridge is detached from the cartridge loading part of the first painting robot. In this case, the paint cartridge is detached from the cartridge loading part with the cartridge grip part of the cartridge carrier in the first region where the movable region of the painting machine of the first painting robot overlaps with the movable region of the cartridge grip part of the cartridge carrier. When the paint cartridge is detached from the cartridge loading part of the second painting robot, the paint cartridge is detached from the cartridge loading part with the cartridge grip part of the cartridge carrier in the second region where the movable region of the painting machine of the second painting robot overlaps with the movable region of the cartridge grip part of the cartridge carrier. It is necessary to clean the paint discharge part of the painting machine after the paint cartridge is detached, so the paint discharge part is cleaned in the cleaning tank. In this case, the cleaning tank can be used to clean the paint discharge part of the painting machine of the first robot in the first region. The cleaning tank is a single tank that is arranged in a position where it is also possible to clean the paint discharge part of the painting machine of the second painting robot in the second region. With only the single cleaning tank, the paint discharge parts of the painting robots (the first painting robot and the second painting robot) can be cleaned. In short, it is possible to implement the configuration in which a single cleaning tank is arranged for a plurality of painting robots. Accordingly, the number of parts count of the painting system can be reduced, and thereby reduced production man hours of the painting system and decreased equipment cost can be achieved.

In the painting system according to the first aspect of the present disclosure, the painting unit may be configured to move relatively to the article to be painted in a horizontal direction. When a virtual plane extending along a route that the article to be painted moves relatively and extending in a vertical direction is defined as a reference plane, the first painting robot may be configured to be disposed on the side same as the side of the second painting robot with respect to the reference plane.

In the painting system according to the first aspect of the present disclosure, the first region and the second region may overlap in a third region, and the cleaning tank may be disposed in the third region.

When the first region and the second region do not overlap, a large cleaning tank disposed over the first region and the second region is needed to achieve cleaning of the paint discharge parts in a plurality of painting robots with only a single cleaning tank. Since the first region and the second region overlap in the third region, and the cleaning tank is disposed in the third region, downsizing of the cleaning tank can be achieved.

The painting system according to the first aspect of the present disclosure may include a paint injector to inject the paint into the paint cartridge. The paint injector may be disposed in the movable region of the cartridge grip part of the cartridge carrier.

In the painting system according to the first aspect of the present disclosure, the cartridge carrier can carry the paint cartridge that is detached from the cartridge loading part to the paint injector, while the cartridge grip part of the cartridge carrier grips the paint cartridge. In other words, it becomes possible to carry the paint cartridge that is detached from the cartridge loading part to the paint injector without changing the carrier of the paint cartridge (without going through other devices). Accordingly, the time from detachment of the paint cartridge to supply to the paint injector can be shortened. Since other devices (devices for changing the carrier that carries the paint cartridge detached from the cartridge loading part) are not required, downsizing of the painting system can be achieved.

In the painting system according to the first aspect of the present disclosure, the movable region of the cartridge grip part of the cartridge carrier may be set as a region over the paint injector, the first region, and the second region.

In the painting system according to the first aspect of the present disclosure, one device can perform both the function of the cartridge carrier for carrying the paint cartridge detached from the cartridge loading part of the first painting robot in the first region to the paint injector, and the function of the cartridge carrier for carrying the paint cartridge detached from the cartridge loading part of the second painting robot in the second region to the paint injector. In other words, simply arranging a single cartridge carrier makes it possible to detach the paint cartridge from the cartridge loading part and carry the paint cartridge to the paint injector for a plurality of painting robots (the first painting robot and the second painting robot). In short, it is possible to implement the configuration in which a single cartridge carrier is arranged for a plurality of painting robots. This also allows reduction in number of parts count of the painting system, and thereby reduced production man hours of the painting system and decreased equipment cost can be achieved.

In the case of the configuration in which the first region and the second region overlap in the third region as described above, both the first painting robot and the second painting robot can perform, with the cartridge grip part of the single cartridge carrier, attaching and detaching operation of the paint cartridge to and from the cartridge loading part of each painting machine in the third region. Specifically, it is possible to perform the attaching and detaching operation of the paint cartridge to and from the cartridge loading part of the painting machine in the first painting robot and the attaching and detaching operation of the paint cartridge to and from the cartridge loading part of the painting machine in the second painting robot practically at the same position. It is also possible to eliminate the necessity of making a large movement of the cartridge grip part of the cartridge carrier in accordance with the target painting robots (that are made to attach or detach the paint cartridge). In the case of successively performing the attaching and detaching operation of the paint cartridge to and from the cartridge loading part of the painting machine in each painting robot, it is also possible to reduce a moving distance of the cartridge grip part of the cartridge carrier, and thereby working time can be shortened.

In the painting system according to the first aspect of the present disclosure, the cartridge grip part of the cartridge carrier may be provided with a plurality of grip units configured to be individually switchable between a grip state and a grip release state of the paint cartridge.

According to the first aspect of the present disclosure, in replacing a paint cartridge to be loaded into the cartridge loading part of the painting machine in the painting robot, the cartridge grip part of the cartridge carrier is moved to the vicinity of the cartridge loading part of the painting machine while an unused paint cartridge (paint cartridge injected with the paint) is gripped by one grip unit. In this state, detaching the paint cartridge (used paint cartridge) from the cartridge loading part using another grip unit, and loading the paint cartridge on the cartridge loading part using the grip unit that grips the unused paint cartridge can successively be performed. Specifically, in the case where only one grip unit is provided, it is necessary to perform such operation as carrying the paint cartridge after it is detached (carrying the detached paint cartridge to a cartridge stocker, or the like, which collects the paint cartridges), then going to a waiting place of the paint cartridges (for example, a paint injection section) to fetch an unused paint cartridge, and carrying the fetched paint cartridge to the cartridge loading part of the painting machine. The painting system according to the first aspect of the present disclosure can eliminate the necessity of such operation. Accordingly, the operation of replacing the paint cartridge can be simplified, and required time can be shortened.

In the painting system according to the first aspect of the present disclosure, at least one of the paint discharge part of the first painting robot or the paint discharge part of the second painting robot may be configured to electrostatically atomize the paint and discharge the atomized paint toward the article to be painted.

The painting system according to the first aspect of the present disclosure can improve deposition efficiency of the paint to the article to be painted, and can reduce the range that the paint discharged toward the article to be painted rebounds. Hence, it becomes unnecessary to arrange the painting robots at the positions further away from the article to be painted so as to prevent the rebounding paint from adhering to the painting robots. This makes it possible to set the arrangement positions of the painting robots to the positions close to the article to be painted. As a result, it becomes possible to downsize the painting system in the horizontal direction that is orthogonal to the direction of relative movement between the article to be painted and the painting units, and to thereby contribute to decreased equipment cost or running cost. Downsizing of the painting system can also provide a $CO_2$ reducing effect.

In the painting system according to the first aspect of the present disclosure, the painting unit may be configured to move relatively to the article to be painted in a horizontal direction, and when a virtual plane extending along a route that the article to be painted moves relatively and extending in a vertical direction is defined as a reference plane, the painting unit may be disposed on both sides of the reference plane. The first painting robot and the second painting robot in the painting unit disposed on one side with respect to the reference plane may each be configured to paint a surface on the one side of the article to be painted. The first painting robot and the second painting robot in the painting unit disposed on the other side with respect to the reference plane may each be configured to paint a surface on the other side of the article to be painted.

In the painting system according to the first aspect of the present disclosure, it becomes possible to satisfactorily paint a region of the article to be painted on one side and a region of the article to be painted on the other side with respect to the reference plane with each of the painting robots in each of the painting units. Hence, the painted surface of the article to be painted can be finished satisfactorily.

A method of painting using the painting system according to the first aspect of the present disclosure is also within the technical idea of the present disclosure. Specifically, the method may include: painting the article to be painted with the paint that is discharged from the first painting robot and the second painting robot, while the article to be painted and the painting unit move relatively; cleaning the paint discharge part of the painting machine of the first painting robot with the single cleaning tank in the first region, after painting operation by the first painting robot is finished; and cleaning the paint discharge part of the painting machine of the second painting robot with the single cleaning tank in the second region, after painting operation by the second painting robot is finished.

With the method of painting using the painting system according to the first aspect of the present disclosure, cleaning of the paint discharge parts of a plurality of painting robots is achieved with a single cleaning tank as described above. Hence, the number of parts count of the painting system can be reduced, and decreased production man hours of the painting system and decreased equipment cost can be achieved.

In the present disclosure, a single cleaning tank that cleans the paint discharge parts of the painting machines in the first painting robot and the second painting robot which constitute a painting unit is arranged at the position where the paint discharge part of the painting machine of the first painting robot can be cleaned and where the paint discharge part of the painting machine of the second painting robot can also be cleaned. Therefore, simply arranging a single cleaning tank makes it possible to clean the paint discharge parts of a plurality of painting robots, and to thereby reduce the number of parts count of the painting system.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

Embodiments of the present disclosure will be described herein below with reference to the drawings. In each of the following embodiments, the present disclosure is applied as a painting system for painting a vehicle body of a vehicle, and a method of painting using the painting system.

First Embodiment

Figure 1:
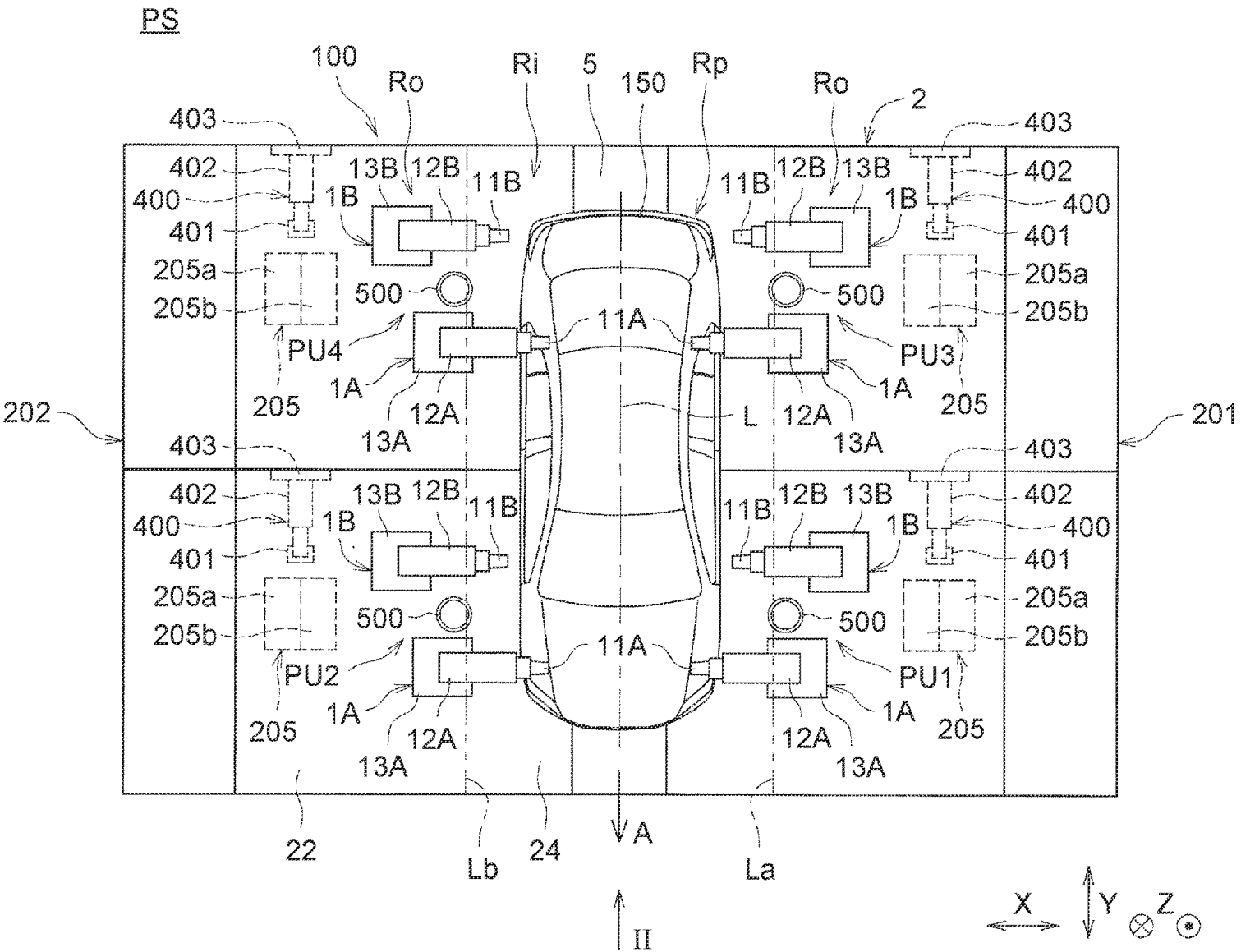
FIG. 1 is a plan view showing a painting system according to a first embodiment.
Figure 2:
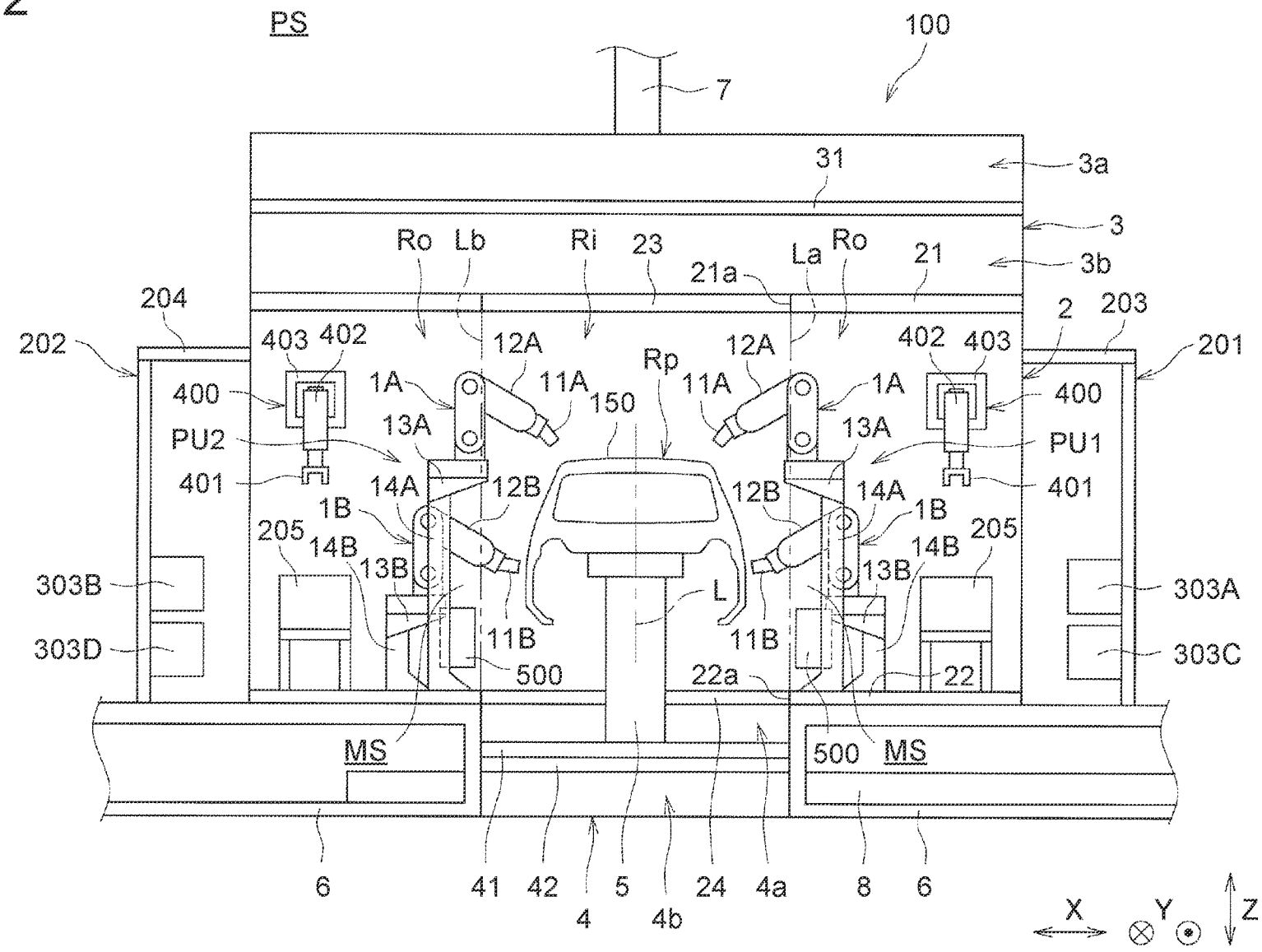
FIG. 2 is a front view showing the painting system according to the first embodiment.

Hereinafter, a first embodiment will be described. FIG. 1 is a plan view showing a painting system PS according to the present embodiment. FIG. 2 is a front view (viewed along arrow II direction in FIG. 1) showing the painting system PS according to the present embodiment. As shown in these drawings, the painting system PS includes a painting booth 100. In the painting booth 100, a plurality of painting units PU1, PU2, PU3, PU4 are installed. On both the sides of the painting booth 100 (both the sides in a horizontal direction), auxiliary booths 201, 202 are installed.

In FIGS. 1 and 2, an X direction is a width direction of the painting system PS, a Y direction is a length direction (carrying direction of a vehicle body 150 as an article to be painted) of the painting system PS, and a Z direction is a height direction (up-down direction) of the painting system PS.

The painting booth 100 includes a carrier 5 for carrying the vehicle body 150. On both the sides of the carrier 5 (both the sides in a direction orthogonal to the carrying direction), two painting units are installed out of painting units PU1, PU2, PU3, PU4.

As shown by arrow Ain FIG. 1, when the vehicle body 150 is carried (when the vehicle body 150 is carried by the carrier 5 from the upper side to the lower side in FIG. 1), the painting units PU1, PU2 located on the downstream side of the carrying direction (painting robots 1A, 1B which constitute the painting units PU1, PU2 to be specific) mainly paint a front half of the vehicle body 150. Specifically, the painting unit PU1 (hereinafter, referred to as a first painting unit PU1) located on the left side as viewed from the carrying direction (right side in FIG. 1) mainly paints a left half of an engine hood of the vehicle body 150, a left-side front fender, a left-side front door, and a left-side front half of a roof. The painting unit PU2 (hereinafter, referred to as a second painting unit PU2) located on the right side as viewed from the carrying direction (left side in FIG. 1) mainly paints a right half of the engine hood of the vehicle body 150, a right-side front fender, a right-side front door, and a right-side front half of the roof.

The painting units PU3, PU4 located on the upstream side of the carrying direction (painting robots 1A, 1B which constitute the painting units PU3, PU4 to be specific) mainly paint a rear half of the vehicle body 150. Specifically, the painting unit PU3 (hereinafter, referred to as a third painting unit PU3) located on the left side as viewed from the carrying direction (right side in FIG. 1) mainly paints a left-side rear fender of the vehicle body 150, a left-side rear door, and a left-side rear half of the roof. The painting unit PU4 (hereinafter, referred to as a fourth painting unit PU4) located on the right side as viewed from the carrying direction (left side in FIG. 1) mainly paints a right-side rear fender of the vehicle body 150, a right-side rear door, and a right-side rear half of the roof.

The painting units PU1 to PU4 have the same configuration. FIG. 2 shows only the first painting unit PU1 and the second painting unit PU2.

Hereinafter, description is given of the painting booth 100, the painting units PU1 to PU4, and the auxiliary booths 201, 202 which constitute the painting system PS according to the present embodiment.

Painting Booth

The painting booth 100 is equipment for painting the vehicle body 150. The painting booth 100 includes a painting chamber (space for painting) 2 in which the painting units PU1 to PU4, later-described cartridge carriers 400, and later-described paint injectors 205 are installed. The painting booth 100 also include an air supply chamber 3 disposed above the painting chamber 2, a collection chamber 4 disposed below the painting chamber 2, and the carrier 5 that carries the vehicle body 150.

The painting chamber 2 is supported by a holding frame 6. The painting chamber 2 has space secured in a lower side for disposing a collection chamber 4. The painting chamber 2 has an inlet 21*a* formed in a part of a ceiling part 21 of the painting chamber 2 for introducing air. The painting chamber 2 has an outlet 22*a* formed in a part of a floor part 22 of the painting chamber 2 for discharging air. The inlet 21*a* is equipped with a filter 23, and the outlet 22*a* is equipped with a grid plate 24. The filter 23 is provided to remove dust or the like, in the air introduced into the painting chamber 2.

The air supply chamber 3 is provided to supply air for ventilation to the painting chamber 2. The air supply chamber 3 is connected to a supply duct 7 to receive air with regulated temperature and humidity from an air conditioner (illustration omitted) through the supply duct 7. The air supply chamber 3 has a function of rectifying the air coming from the supply duct 7. In the internal space of the air supply chamber 3, an air volume regulation mechanism 31 is provided. Accordingly, the internal space of the air supply chamber 3 is divided into upstream-side space 3*a* and downstream-side space 3*b* by the air volume regulation mechanism 31. The upstream-side space 3*a* communicates with the supply duct 7. The downstream-side space 3*b* communicates with the painting chamber 2 through the filter 23 of the inlet 21*a*. The air volume regulation mechanism 31 is configured to regulate an air volume in the air supply chamber 3 such that the air volume around the vehicle body 150 becomes a preset value.

The collection chamber 4 is provided to collect paint particles in the air that is discharged from the painting chamber 2. The collection chamber 4 is connected to an exhaust duct 8, and communicates with the outside through the exhaust duct 8. A filter 41 and an air volume regulation mechanism 42 are provided in internal space of the collection chamber 4. Accordingly, the internal space of the collection chamber 4 is divided into upstream-side space 4*a* and downstream-side space 4*b* by the filter 41 and the air volume regulation mechanism 42. The filter 41 is disposed above the air volume regulation mechanism 42. In short, the filter 41 faces the upstream-side space 4*a*, and the air volume regulation mechanism 42 faces the downstream-side space 4*b*. The upstream-side space 4*a* communicates with the painting chamber 2 through the grid plate 24 of the outlet 22*a*. The downstream-side space 4*b* communicates with the exhaust duct 8. The filter 41 is a thin dry filter that is provided to remove the paint particles in the air. The air volume regulation mechanism 42 is configured to regulate the air volume in the collection chamber 4 such that the air volume around the vehicle body 150 becomes a preset value.

The carrier 5 is provided to carry in the vehicle body 150 to the painting chamber 2 and carry out the vehicle body 150 from the painting chamber 2. The carrier 5 is configured, for example, to carry the vehicle body 150 to the near side with respect to the sheet of FIG. 2.

The painting booth 100 of the present embodiment is configured such that the air coming from the air supply chamber 3 to the collection chamber 4 flows to a predetermined region Ri in the painting chamber 2 while the air coming from the air supply chamber 3 to the collection chamber 4 does not flow to a predetermined outer region Ro in the painting chamber 2. The predetermined region Ri is a region including a passing region Rp in the painting chamber 2, where the vehicle body 150 passes, and a region around the passing region Rp. The predetermined region Ri is a region including the range where the paint particles not deposited on the vehicle body 150 (overspray mist) float at the time of painting. The predetermined outer region Ro is a region other than the predetermined region Ri in the painting chamber 2. The predetermined outer region Ro is disposed on the outer side of the predetermined region Ri in a width direction (X direction).

The inlet 21*a* is disposed at the position corresponding to the passing region Rp of the vehicle body 150. The inlet 21*a* has a width (X direction length) larger than the width of the vehicle body 150 and smaller than the width of the painting chamber 2. For example, the width of the inlet 21*a* is set based on the width of the vehicle body 150 and the width of the range where the paint particles not deposited on the vehicle body 150 (overspray mist) float at the time of painting. In short, the width of the inlet 21*a* is set in accordance with the width of the predetermined region Ri including the range where overspray mist is generated. The inlet 21*a* is provided along the overall length in the length direction (Y direction) of the painting chamber 2.

The outlet 22*a* is disposed at the position corresponding to the passing region Rp of the vehicle body 150. The outlet 22*a* has a width (X direction length) same as the width of the inlet 21*a*, for example. The width of the outlet 22*a* is set in accordance with the width of the predetermined region Ri including the range where overspray mist is generated. The outlet 22*a* is provided along the entire length in the length direction of the painting chamber 2.

At the time, the air coming from the inlet 21*a* to the outlet 22*a* mainly passes through the space between a two-dot chain line La and a two-dot chain line Lb of FIG. 2. The two-dot chain line La is a line connecting one end portion of the width direction of the inlet 21*a* and one end portion of the width direction of the outlet 22*a*. The two-dot chain line Lb is a line connecting the other end portion of the width direction of the inlet 21*a* and the other end portion of the width direction of the outlet 22*a*. The predetermined region Ri is a region including, for example, the space between the two-dot chain lines La and Lb and the space where an airflow spreads.

Painting Unit

The painting units PU1 to PU4 each include two painting robots 1A, 1B which are articulated robots. Therefore, the painting system PS is configured to include eight painting robots 1A, 1B. The painting robots 1A, 1B are constituted of air-driven articulated robots having the same configurations. The painting robots 1A, 1B are configured to atomize paint and apply the atomized paint to the vehicle body 150. The painting robots 1A, 1B include spray guns 11A, 11B for spraying the paint to the vehicle body 150, robot arms 12A, 12B for moving the spray guns 11A, 11B, robot bases 13A, 13B for supporting the robot arms 12A, 12B, and supports 14A, 14B that the robot bases 13A, 13B are attached on. The spray guns 11A, 11B are examples of "painting machines". The supports 14A, 14B are formed so as to extend upward from the floor part 22 of the painting chamber 2.

The two painting robots 1A, 1B included in each of the painting units PU1 to PU4 are disposed at positions different from each other and different in function. The painting robot 1A included in each of the painting units PU1 to PU4 mainly paints an upper region of the vehicle body 150 as a first painting robot. The painting robot 1B mainly paints the region ranging from a side portion to a lower portion of the vehicle body 150 as a second painting robot. For example, in the first painting unit PU1 and the second painting unit PU2, the first painting robot 1A mainly paints a roof and an engine hood of the vehicle body 150. Meanwhile, the second painting robot 1B mainly paints a front fender and a front door of the vehicle body 150.

In the present embodiment, arrangement positions of the first painting robot 1A and the second painting robot 1B in each of the painting units PU1 to PU4 are as shown in FIG. 1. That is, the first painting robot 1A is arranged on the downstream side (lower side in FIG. 1) in the carrying direction of the vehicle body 150 than the second painting robot 1B.

An installation position of the support 14A of the first painting robot 1A in each of the painting units PU1 to PU4 is set to the position closer to the carrier 5 than the installation position of the support 14B of the second painting robot 1B. In other words, when a virtual plane extending along a carrying direction of the vehicle body 150 by the carrier 5 and extending in a vertical direction through the center of the vehicle body 150 is defined as a reference plane L, a distance between the installation position of the support 14A of the first painting robot 1A and the reference plane L (distance in a horizontal direction) in each of the painting units PU1 to PU4 is set to be shorter than a distance between the installation position of the support 14B of the second painting robot 1B and the reference plane L. Specifically, as shown in FIG. 1, the supports 14A, 14B in each of the painting robots 1A, 1B (painting robots 1A, 1B disposed on the same side with respect to the reference plane L) are disposed in the predetermined outer region Ro and at positions not overlapping with the inlet 21*a* and the outlet 22*a* in a plane view (at positions shifted from the inlet 21*a* and the outlet 22*a*). The installation position of the support 14B of the second painting robot 1B is set to be outer side relative to the installation position of the support 14A of the first painting robot 1A.

A height size of the support 14A of the first painting robot 1A in each of the painting units PU1 to PU4 is set to be larger than the height size of the support 14B of the second painting robot 1B. Accordingly, the arrangement height position of the robot base 13A of the first painting robot 1A is set to be higher than the arrangement height position of the robot base 13B of the second painting robot 1B. As a result, the installation position of the robot arm 12A of the first painting robot 1A becomes higher than the installation position of the robot arm 12B of the second painting robot 1B. Therefore, the first painting robot 1A functions to paint an upper region of the vehicle body 150, and the second painting robot 1B functions to paint a lower region of the vehicle body 150.

Since the painting robots 1A, 1B are installed in this way, the first painting robot 1A of the first painting unit PU1 and the first painting robot 1A of the second painting unit PU2 are disposed to face each other across the passing region Rp of the vehicle body 150 in the width direction as shown in FIG. 2. Similarly, the second painting robot 1B of the first painting unit PU1 and the second painting robot 1B of the second painting unit PU2 are disposed to face each other across the passing region Rp of the vehicle body 150 in the width direction. The first painting robot 1A of the third painting unit PU3 and the first painting robot 1A of the fourth painting unit PU4 are also disposed to face each other across the passing region Rp of the vehicle body 150 in the width direction. Similarly, the second painting robot 1B of the third painting unit PU3 and the second painting robot 1B of the fourth painting unit PU4 are disposed to face each other across the passing region Rp of the vehicle body 150 in the width direction.

Description is now given of the spray guns 11A, 11B included in each of the painting robots 1A, 1B. The spray guns 11A, 11B in each of the painting robots 1A, 1B have the same configuration. Here, the spray gun 11A included in the first painting robot 1A is representatively described.

Figure 3:
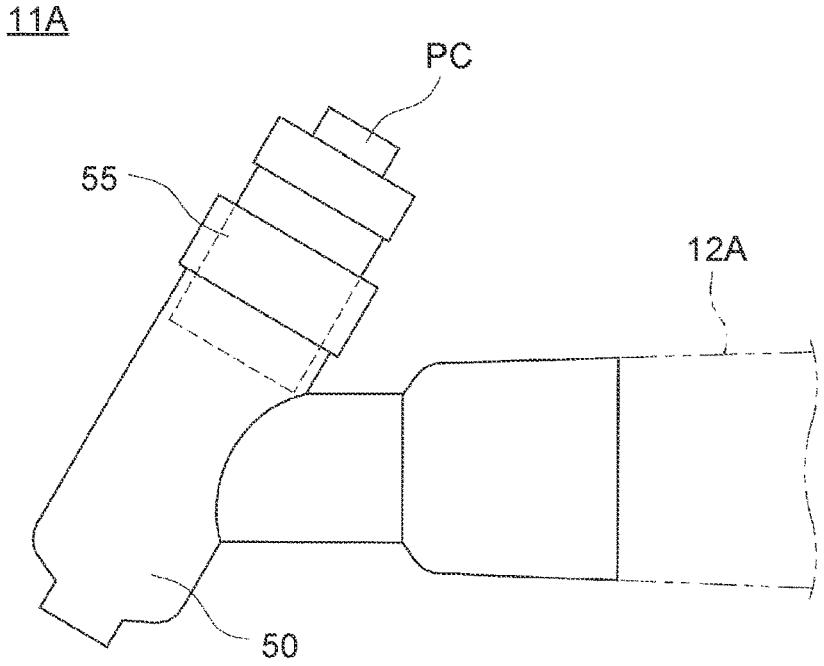
FIG. 3 is a side view showing a spray gun included in a robot arm of a painting robot.
Figure 4:
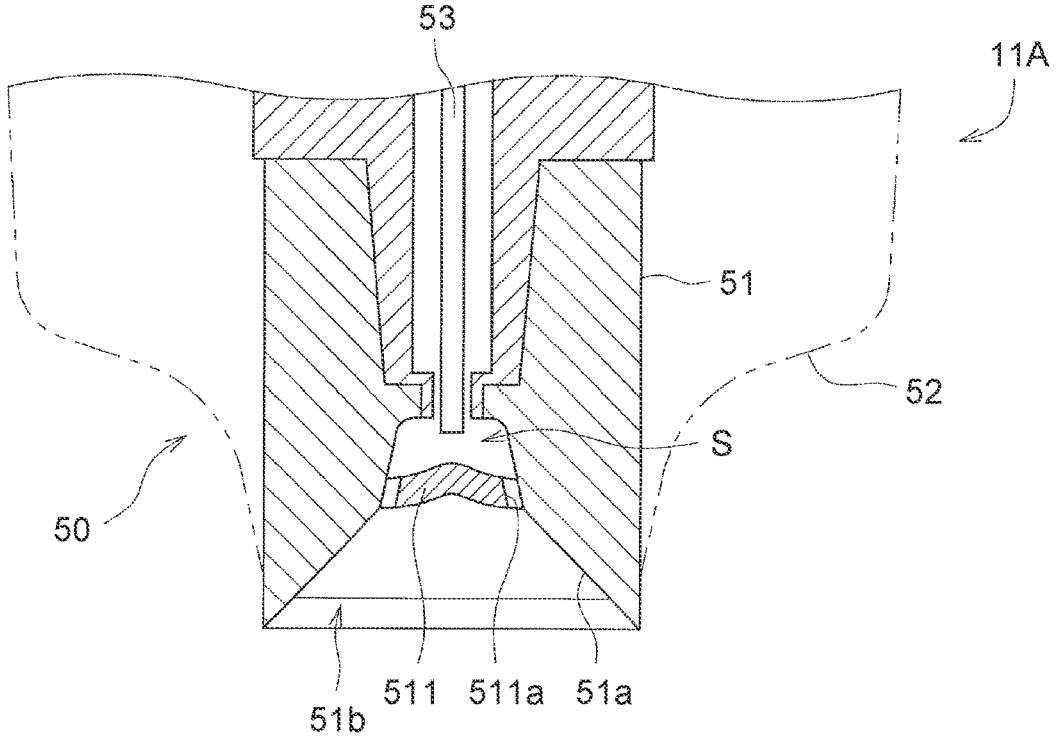
FIG. 4 is a sectional view showing a rotary head of the spray gun and a periphery thereof.
Figure 5:
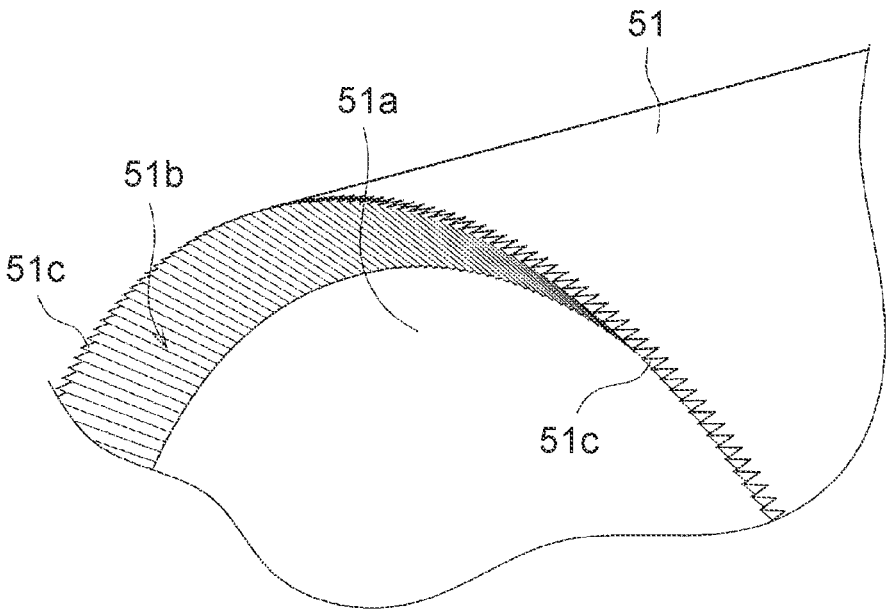
FIG. 5 is a perspective view showing a tip of the rotary head of the spray gun.
Figure 6:
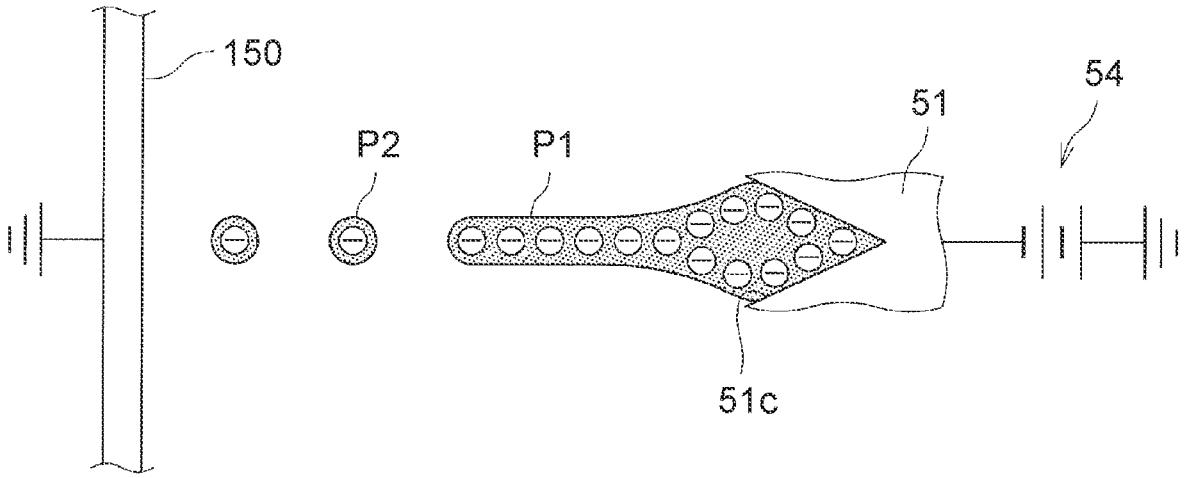
FIG. 6 is a schematic view for illustrating electrostatic atomization of paint.

FIG. 3 is a side view showing the spray gun 11A included in the robot arm 12A. FIG. 4 is a sectional view showing a rotary head 51 of the spray gun 11A and a periphery thereof. FIG. 5 is a perspective view showing a tip of the rotary head 51 of the spray gun 11A. FIG. 6 is a schematic view for illustrating electrostatic atomization of paint.

As shown in FIG. 3, the spray gun 11A includes a cartridge loading part 55 and a paint discharge part 50.

The cartridge loading part 55 allows removable loading of a paint cartridge PC. The cartridge loading part 55 has a cylindrical shape with its upper side opened in the attitude shown in FIG. 3. A desired paint cartridge (paint cartridge injected with a desired paint used for painting the vehicle body 150) PC is loaded (inserted) into an opening provided on the upper portion of the cartridge loading part 55, and the paint in the paint cartridge PC is supplied to the paint discharge part 50.

The paint cartridge PC is constituted of an approximately cylindrical container having a hollow inside. The paint cartridge PC is injected with a predetermined paint in advance by a paint injection part 205*b* of the paint injector 205 described later. The paint cartridge PC loaded into the cartridge loading part 55 is injected with paint in advance, the paint being required for painting the vehicle body 150 that is carried in to the painting system PS. The painting system PS provides a plurality of paint cartridges PC. The paint cartridges PC may be special paint cartridges corresponding to respective types of paint, or may be general-purpose paint cartridges to be applied to different types of the paint by cleaning the inside of the cartridges. Even in the case of the special paint cartridges, it is desirable to clean the inside of the paint cartridges PC before being injected with paint. In the case of the special paint cartridges, the number of necessary paint cartridges PC is equal to or more than a value obtained by multiplying the number of the types of paint to be used for painting in the painting system PS by the number of the painting robots 1A, 1B. In the case of the general-purpose paint cartridges, the number of necessary paint cartridges PC can be smaller than a value obtained by multiplying the number of the types of paint to be used for painting in the painting system PS by the number of the painting robots 1A, 1B.

The paint discharge part 50 sprays the paint in the paint cartridge PC that is loaded into the cartridge loading part 55 to the vehicle body 150. Specifically, the paint discharge part 50 is configured to emit thread-shaped paint P1 from the rotary head 51, electrostatically atomize the thread-shaped paint P1 to form paint particles (atomized paint) P2, and deposit the paint to the vehicle body 150.

As shown in FIG. 4, the paint discharge part 50 includes the rotary head 51, an air motor (illustration omitted) for rotating the rotary head 51, a cap 52 that covers the outer peripheral surface of the rotary head 51, a paint supply pipe 53 that supplies paint to the rotary head 51, and a voltage generator 54 (see FIG. 6) for applying negative high voltage to the rotary head 51.

The rotary head 51 is configured to receive liquid paint and emit the received paint by centrifugal force. The rotary head 51 is equipped with a hub 511 to form a paint space S. The paint space S receives the paint supplied from the paint supply pipe 53. The hub 511 has an outer edge portion having a plurality of discharge holes 511*a* formed to discharge the paint from the paint space S.

On the radially outer side of the discharge holes 511*a* of the rotary head 51, a diffusing surface 51*a* is formed to diffuse the paint by centrifugal force. The diffusing surface 51*a* is formed to have a larger diameter toward the tip of the rotary head 51, and is configured to make the paint that is discharged from the discharge holes 511*a* into a film-shaped paint. As shown in FIG. 5, the diffusing surface 51*a* has an outer edge portion 51*b* having groove portions 51*c* formed to emit the film-shaped paint in the form of thread. In FIG. 4, illustration of the groove portions 51*c* is omitted for viewability.

The groove portions 51*c* are provided so as to extend in the radial direction as viewed from an axial direction, and are provided in the circumferential direction. In short, the groove portions 51*c* are formed on the outer edge portion 51*b* of the diffusing surface 51*a* so as to extend in the inclined direction of the diffusing surface 51*a*. The groove portions 51*c* are formed so as to extend up to a radially outer end portion of the rotary head 51. Hence, the tip of the rotary head 51 has an uneven shape as viewed from the side of the outer peripheral surface.

In the rotary head 51, as shown in FIG. 6, the voltage generator 54 applies negative high voltage to the rotary head 51, and thereby the thread-shaped paint P1 emitted from the groove portions 51*c* of the rotary head 51 is charged. With repulsive force caused by electrification charging, the thread-shaped paint P1 is split into paint particles P2. Hence, the thread-shaped paint P1 emitted from the groove portions 51*c* of the rotary head 51 is electrostatically atomized into paint particles P2. Specifically, since the air discharge part that discharges shaping air is not provided in the painting robots 1A, 1B, the paint particles P2 are formed without using shaping air. Therefore, the painting robots 1A, 1B employ an electrostatic atomization method without using shaping air, which prevents soaring of the paint particles due to shaping air. As a result, generation of overspray mist is suppressed, and a generation range of the overspray mist is narrowed.

As shown in FIGS. 1 and 2, the painting booth 100 is provided with the paint injectors 205 and the cartridge carriers 400 corresponding to the painting units PU1 to PU4.

The paint injector 205 houses a plurality of paint cartridges PC to be loaded into the cartridge loading part 55 included in the spray guns 11A, 11B in the painting robots 1A, 1B. Accordingly, the paint injector 205 has a plurality of unshown recess portions arranged in a plurality of places for housing the paint cartridges PC. As the paint cartridges PC housed in the paint injector 205, there are a plurality of types of paint cartridges corresponding to the types of paint which may be used for painting in the painting system PS as described before.

More specifically, the paint injector 205 includes a cartridge stocker 205*a* for holding empty paint cartridges PC (not injected with paint) in a standby state, and a paint injection part 205*b* for performing operation of injecting the paint into the paint cartridge PC, or the like. Each of the cartridge stocker 205*a* and the paint injection part 205*b* can hold a plurality of paint cartridges PC (hold in the recess portions). In the present embodiment, the arrangement position of the cartridge stocker 205*a* is on the outer side in a width direction (the side far from the reference plane L), and the arrangement position of the paint injection part 205*b* is on the inner side in the width direction (the side close to the reference plane L). However, the arrangement positions are not limited to these. It is also possible to adopt the configuration in which the cartridge stocker 205*a* and the paint injection part 205*b* are individually arranged (arranged away from each other).

The cartridge stocker 205*a* holds the paint cartridges PC not scheduled to be used, and the paint cartridges PC scheduled to be used for painting the vehicle body 150 in the future.

Figure 7:
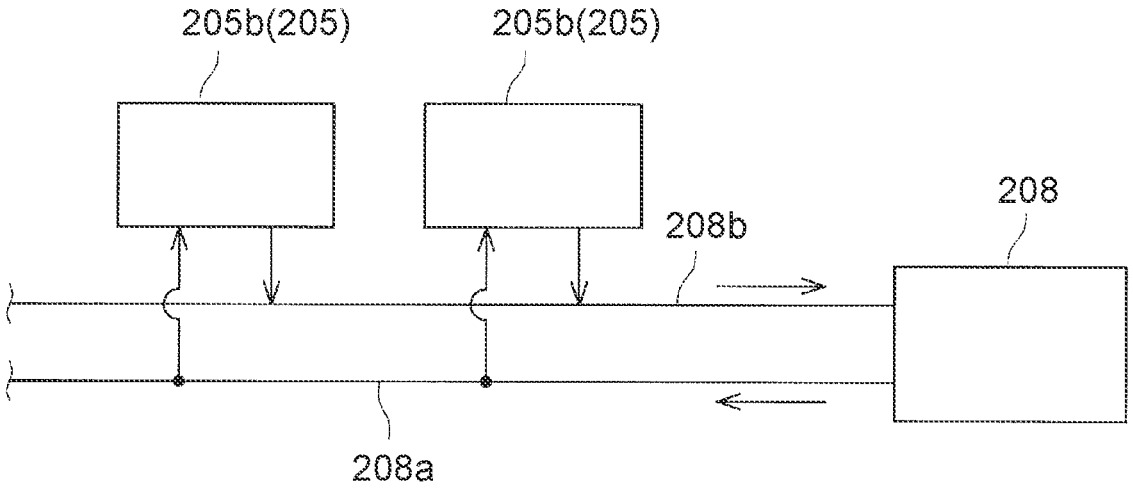
FIG. 7 is a schematic configuration view partially showing a supply system of paint to each paint injector.

The paint injection part 205*b* is connected to a paint supply system for injecting a desired paint in the empty paint cartridge PC held in the paint injection part 205*b*. FIG. 7 is a schematic configuration view showing a part of the paint supply system (paint supply system for the paint of one type). As shown in FIG. 7, the paint supply system includes a paint mixing device 208, a paint supply pipe 208*a*, and a paint collection pipe 208*b*. The paint mixing device 208 generates a specific type of paint by mixing. Accordingly, the painting system PS is provided with the paint mixing devices 208 of the number corresponding to the types of paint used for painting in the painting system PS. The paint supply pipe 208*a* is a pipeline that connects the paint mixing device 208 and the paint injection part 205*b* in each of the painting units PU1 to PU4. The paint collection pipe 208*b* is also a pipeline that connects the paint mixing device 208 and the paint injection part 205*b* in each of the painting units PU1 to PU4. In the case of injecting a desired paint to a specific empty paint cartridge PC held in the paint injection part 205*b*, the paint is supplied from the corresponding paint mixing device 208 to the paint cartridge PC (empty paint cartridge PC) through the corresponding paint supply pipe 208*a*. The excessive paint is also collected into the corresponding paint mixing device 208 through the corresponding paint collection pipe 208*b*. The paint is supplied and collected when a pressure pump, which is not illustrated, included in the paint mixing device 208 is driven, for example. Thus, for the paint injection parts 205*b*, the paint supply pipe 208*a* and the paint collection pipe 208*b* of one system are provided for every type of paint. Accordingly, the number of pipelines can be reduced as compared with the case where individual pipelines are provided for each of the paint injection parts 205*b*. Therefore, it becomes possible to simplify the configuration of the painting system PS. Since one paint injection part 205*b* is arranged for two painting robots 1A, 1B in the present embodiment, the number of pipelines (the number of branch pipelines extending toward each of the paint injection parts 205*b*) can be reduced as compared with the prior art where the paint injection part is arranged for each of the painting robots. This also makes it possible to simplify the configuration of the painting system PS.

In the present embodiment, the paint injection part 205*b* also includes a cleaning function of the paint cartridge PC. In one example, the paint injection part 205*b* is connected to a cleaning water pipeline which is not illustrated. Through the cleaning water pipeline, cleaning water is supplied to the inside of the paint cartridges PC that are collected into the paint injection part 205*b* (detached and collected from each of the spray guns 11A, 11B of the painting robots 1A, 1B), and thereby the inside of the painting cartridges PC is cleaned. The configuration for cleaning the paint cartridge PC is not limited to this. A cartridge cleaning device for cleaning the inside of the paint cartridge PC may be installed independently of the paint injection part 205*b*. Specifically, the cartridge stocker, the paint injection part, and the cartridge cleaning device may integrally be configured.

The paint cartridge PC cleaned in the paint injection part 205*b* is temporarily collected into the cartridge stocker 205*a*, and is put in a standby state until a paint injection request is created. At the time when a paint injection request is created (for example, when an injection request of the paint used for painting the vehicle body 150 that is to be carried in the next to the painting system PS is created), the paint cartridge PC is carried from the cartridge stocker 205*a* to the paint injection part 205*b* by the cartridge carrier 400 described later, and injection operation of a desired paint is performed.

Thus, in the present embodiment, the cartridge stocker 205*a* and the paint injection part 205*b* are housed in the paint injector 205. The cartridge stocker 205*a* and the paint injection part 205*b* are arranged to be close to each other. As will be described later, in the carrying operation of the paint cartridge PC, the paint cartridge PC is transferred (carried) between the cartridge stocker 205*a* and the paint injection part 205*b*. When the cartridge stocker 205*a* and the paint injection part 205*b* are arranged to be close to each other, the transfer distance can be shortened and the time taken for transfer can be reduced.

The cartridge carrier 400 is configured to replace the paint cartridge PC loaded into the cartridge loading part 55, in the case where a residual amount of paint in the paint cartridge PC loaded into the cartridge loading part 55 of the spray guns 11A, 11B becomes small after the end of painting work in the painting system PS, or in the case of changing the type (e.g., changing the color) of the paint to be used for painting the next vehicle body 150 that is carried into the painting system PS. The cartridge carrier 400 is constituted of an articulated robot like each of the painting robots 1A, 1B. Specifically, the cartridge carrier 400 includes a cartridge grip part 401 that grips the paint cartridge PC, a robot arm 402 that moves the cartridge grip part 401, and a robot base 403 that supports the robot arm 402. In the cartridge carrier 400 in the present embodiment, the robot base 403 is supported by the frame of the painting booth 100, or the like. Since both the robot base 403 of the cartridge carrier 400 and the robot bases 13A, 13B of the painting robots 1A, 1B are fixed, the relative positions of the robot bases 403, 13A, 13B are unchanged.

In the case of changing the type (e.g., changing the color) of the paint to be used for next painting after the end of the painting work in the painting system PS, the robot arm 402 of the cartridge carrier 400 operates, and the cartridge grip part 401 detaches the paint cartridge PC from the cartridge loading part 55 of the spray gun 11A. As a result, the cartridge grip part 401 carries the paint cartridge PC to the paint injector 205 (the paint injection part 205*b*, to be specific).

The cartridge grip part 401 in the cartridge carrier 400 can grip two paint cartridges PC at the same time. For example, in the configuration of gripping the upper portion of the paint cartridge PC with two gripping holders as shown in FIGS. 12A-12H, grip units 404, 405 having two gripping holders are provided at two places, respectively. When the grip units 404, 405 operate independently, they can perform gripping operation of the paint cartridge PC (operation to grip the paint cartridges PC) and grip release operation (operation to release the gripping of the paint cartridge PC) independently of each other. The gripping operation and the grip release operation in the grip units 404, 405 are performed when the gripping holders are moved by operation of an electric motor, which is not illustrated. Note that the carrying operation of the paint cartridges PC by the grip units 404, 405 will be described later.

Between the first painting robot 1A and the second painting robot 1B in each of the painting units PU1 to PU4, a cleaning tank 500 for cleaning the paint discharge parts 50 of the spray guns 11A, 11B is arranged. The cleaning tank 500 is constituted of a bottomed cylindrical container with cleaning water stored therein. In the cleaning tank 500, an injection nozzle, which is not illustrated, is arranged for injecting cleaning water toward the inside of the paint discharge part 50. In the state where the paint cartridges PC are detached from the cartridge loading parts 55 of the spray guns 11A, 11B after the end of the painting work in the painting system PS, the spray guns 11A, 11B are located in the inside of the cleaning tank 500, and the inside and the outside of the paint discharge parts 50 of the spray guns 11A, 11B are cleaned. As describe before, the cleaning tank 500 is arranged between the first painting robot 1A and the second painting robot 1B. Accordingly, in the case of cleaning the inside and the outside of the paint discharge parts 50 of the spray guns 11A, 11B in the painting robots 1A, 1B, interference of the painting robots 1A, 1B (robot arms 12A, 12B) can be reduced.

Movable Regions of Spray Gun and Cartridge Grip Part

Description is now given of the movable regions of the spray guns 11A, 11B in the painting robots 1A, 1B and the movable region of the cartridge grip part 401 in the cartridge carrier 400, which are one of the characteristics of the present embodiment. The movable regions of the spray guns 11A, 11B in each of the painting units PU1 to PU4 and the movable region of the cartridge grip part 401 are the same. Here, the movable regions of the spray guns 11A, 11B in the first painting unit PU1 and the movable region of the cartridge grip part 401 will be described representatively.

Figure 8:
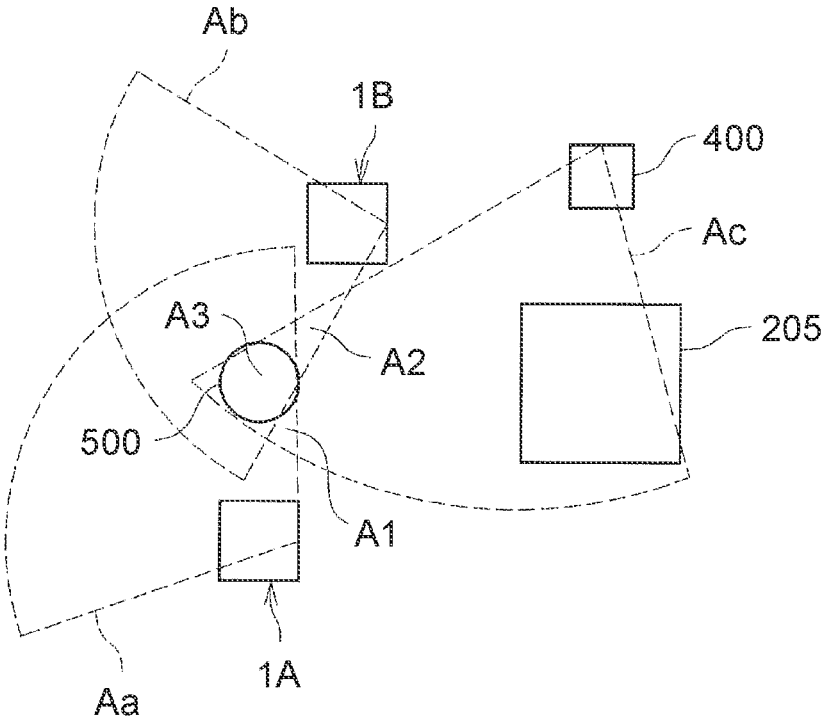
FIG. 8 is a plan view schematically showing movable regions of the spray guns moved by the robot arms of the painting robots in the first painting unit, and a movable region of a cartridge grip part moved by a robot arm of a cartridge carrier.
Figure 9:
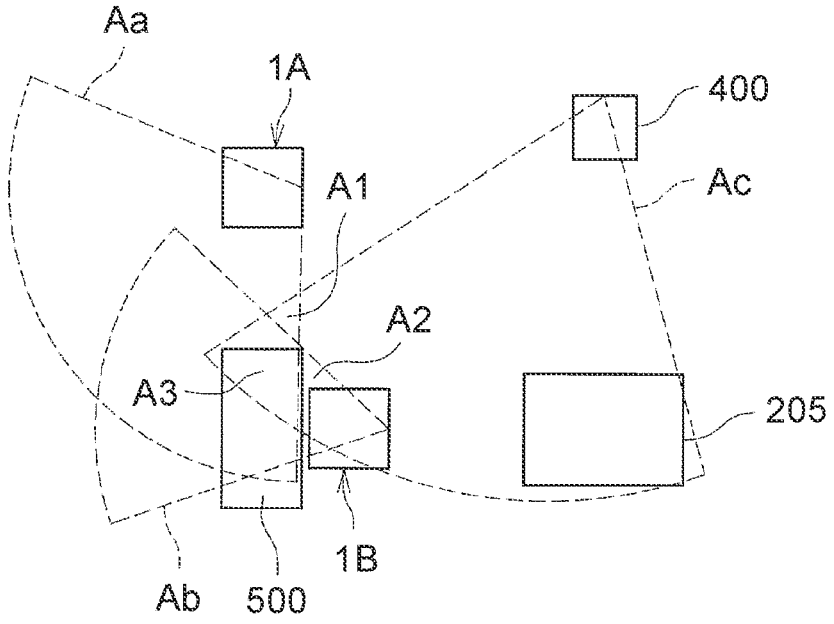
FIG. 9 is a front view schematically showing the movable regions of the spray guns moved by the robot arms of the painting robots in the first painting unit, and the movable region of the cartridge grip part moved by the robot arm of the cartridge carrier.

FIG. 8 is a plan view (corresponding to FIG. 1) schematically showing the movable regions of the spray guns 11A, 11B by the robot arms 12A, 12B of the painting robots 1A, 1B of the first painting unit PU1, and the movable region of the cartridge grip part 401 by the robot arm 402 of the cartridge carrier 400. FIG. 9 is a front view (corresponding to FIG. 2) schematically showing the movable regions of the spray guns 11A, 11B by the robot arms 12A, 12B of the painting robots 1A, 1B in the first painting unit PU1, and the movable region of the cartridge grip part 401 by the robot arm 402 of the cartridge carrier 400. In FIGS. 8 and 9, the movable regions of the spray guns 11A, 11B and the movable regions of the cartridge grip part 401 are each expressed as a region encircled with a broken line. In FIGS. 8 and 9, reference sign Aa denotes the movable region of the spray gun 11A of the first painting robot 1A, reference sign Ab denotes the movable region of the spray gun 11B of the second painting robot 1B, and reference sign Ac denotes the movable region of the cartridge grip part 401 of the cartridge carrier 400.

As shown in FIGS. 8 and 9, a part of the movable region Aa of the spray gun 11A of the first painting robot 1A overlaps with a part of the movable region Ac of the cartridge grip part 401 of the cartridge carrier 400. Hereinafter, the overlapping region is called a first region A1. Moreover, a part of the movable region Ab of the spray gun 11B of the second painting robot 1B overlaps with a part of the movable region Ac of the cartridge grip part 401 of the cartridge carrier 400. Hereinafter, the overlapping region is called a second region A2.

In the present embodiment, a part of the first region A1 and a part of the second regions A2 overlap. Hereinafter, the overlapping region is called a third region A3. As shown in FIG. 8, as viewed in a plane view, the third region A3 is set to a position between the first painting robot 1A and the second painting robot 1B. More specifically, the third region A3 is set to a position closer to the reference plane L than the position of the support 14B of the second painting robot 1B (the position of the support 14B of the second painting robot 1B arranged at the position farther from the reference plane L, out of the painting robots 1A, 1B).

The cleaning tank 500 is arranged at the third region A3. Specifically, the cleaning tank 500 is located in the inside of all the regions including the movable region Aa of the spray gun 11A of the first painting robot 1A, the movable region Ab of the spray gun 11B of the second painting robot 1B, and the movable region Ac of the cartridge grip part 401 of the cartridge carrier 400. With the cleaning tank 500, the paint discharge part 50 of the spray gun 11A of the first painting robot 1A can be cleaned (cleaning with the cleaning tank 500 is possible in the state where the paint discharge part 50 of the first painting robot 1A is located in the third region A3 that overlaps with the first region A1). With the cleaning tank 500, the paint discharge part 50 of the spray gun 11B of the second painting robot 1B can be cleaned (cleaning with the cleaning tank 500 is possible in the state where the paint discharge part 50 of the second painting robot 1B is located in the third region A3 that overlaps with the second region A2). In short, the paint discharge parts 50 of the first painting robot 1A and the second painting robot 1B can be cleaned with the single cleaning tank 500.

The paint injector 205 is arranged in the movable region Ac of the cartridge grip part 401 of the cartridge carrier 400. Accordingly, the cleaning tank 500 and the paint injector 205 are arranged in the movable region Ac of the cartridge grip part 401. In other words, the cartridge grip part 401 of the cartridge carrier 400 is movable between the paint injector 205, the first region A1, and the second region A2.

Auxiliary Booths

The auxiliary booths 201, 202 are arranged on both outer sides of the painting booth 100 (both the outer sides in a horizontal direction). Here, the auxiliary booth 201 located on the right side in FIG. 2 is called a first auxiliary booth, and the auxiliary booth 202 located on the left side in FIG. 2 is called a second auxiliary booth.

The auxiliary booths 201, 202 are constituted as space surrounded with frames 203, 204. The auxiliary booths 201, 202 are provided with control devices 303A, 303B, 303C, 303D for controlling each device provided in the painting units PU1 to PU4. That is, the first control device 303A for controlling each device provided in the first painting unit PU1 and the third control device 303C for controlling each device provided in the third painting unit PU3 are arranged in the first auxiliary booth 201. The second control device 303B for controlling each device provided in the second painting unit PU2 and the fourth control device 303D for controlling each device provided in the fourth painting unit PU4 are arranged in the second auxiliary booth 202. In the present embodiment, the control devices 303A to 303D are supported by the side surfaces of the frames 203, 204 (side surfaces facing the inside of the auxiliary booths 201, 202).

Thus, the control devices 303A to 303D are provided so as to correspond to the painting units PU1 to PU4, respectively. Each of the painting units PU1 to PU4 is provided with two painting robots 1A, 1B. Accordingly, the control devices 303A to 303D each have a function of controlling two painting robots 1A, 1B together. In other words, the control devices 303A to 303D each control operation of the first painting robot 1A and operation of the second painting robot 1B together. As described before, the painting robots 1A, 1B are air-driven articulated robots. Hence, the control devices 303A, 303B, 303C, 303D are each configured to include an air pressure control board for controlling the painting robots 1A, 1B. The control devices 303A, 303B, 303C, 303D may also each include a circuit board.

Configuration of Control System

Figure 10:
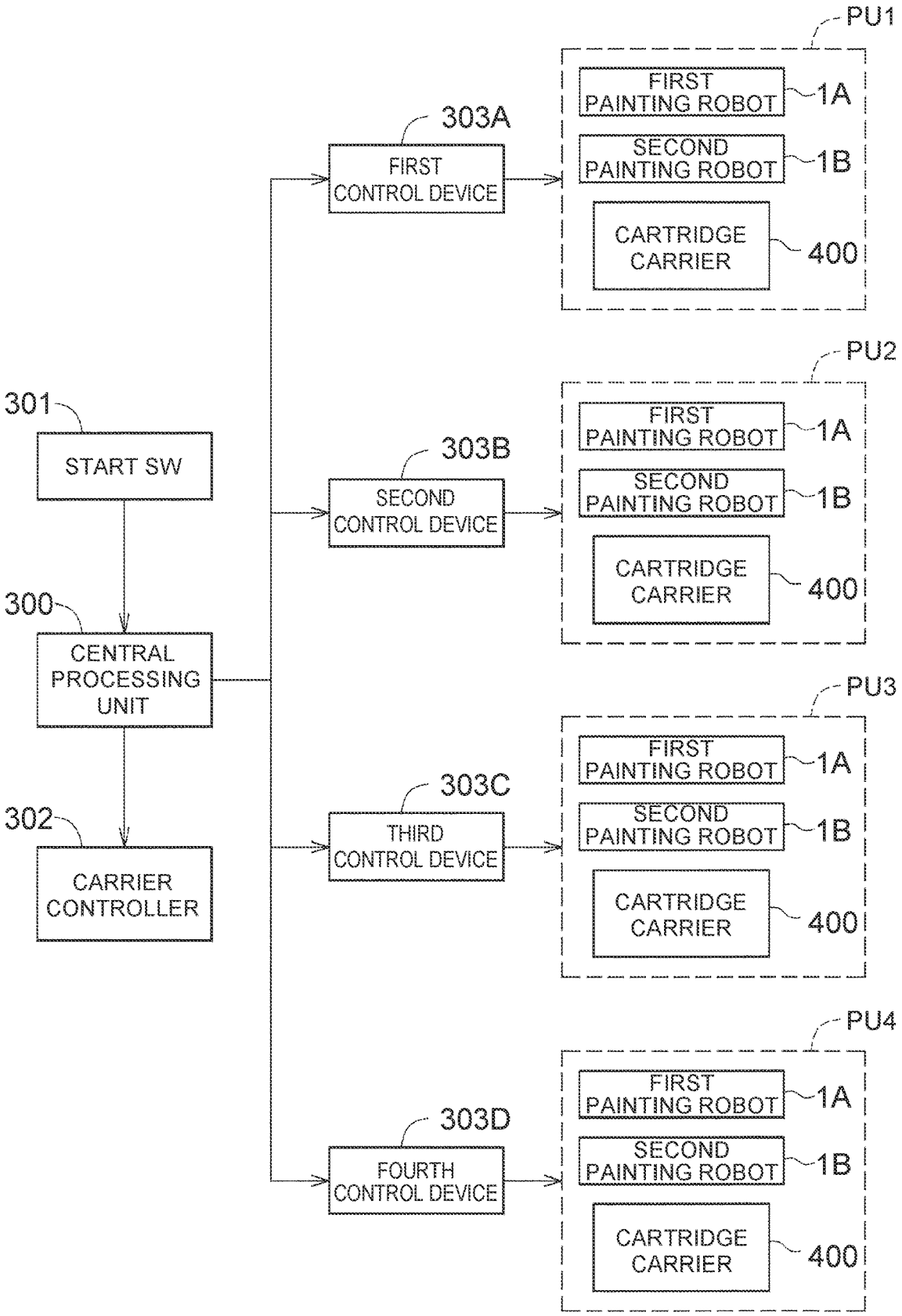
FIG. 10 is a block diagram showing the schematic configuration of a control system in the painting system.

Next, a control system of the painting units will be described. FIG. 10 is a block diagram showing the schematic configuration of the control system in the painting system PS according to the present embodiment. As shown in the FIG. 10, the control system of the painting system PS is configured as follows. That is, a central processing device 300 that comprehensively controls the painting system PS, a start switch 301, a carrier controller 302, the first to fourth control devices 303A to 303D, and the first to fourth painting units PU1 to PU4 are electrically connected so as to be able to transmit and receive various signals, such as command signals.

The start switch 301 transmits a start command signal of the painting system PS to the central processing device 300 in accordance with operation of an operator. Upon reception of the start command signal, the painting system PS starts (activates), and later-described painting operation is started.

The carrier controller 302 controls carrying of the vehicle body 150 by the carrier 5. Specifically, the carrier controller 302 operates the carrier 5 until the vehicle body 150 reaches a predetermined position (position shown in FIG. 1) in the painting booth 100. From this point of time, the carrier controller 302 moves the vehicle body 150 at predetermined carrying speed (preset speed suitable for painting operation). Then, after a predetermined time has passed since painting the vehicle body 150 is finished, the carrier controller 302 operates the carrier 5 such that the vehicle body 150 is carried from the painting booth 100 to a next station at speed for carrying out vehicle body. The carrier controller 302 also operates the carrier 5 such that the vehicle body 150 that is a next painting target is carried to the painting booth 100.

The control devices 303A to 303D receive command signals from the central processing device 300. In response to the command signals, the control devices 303A to 303D output control command signals to the painting units PU1 to PU4. Specifically, the first control device 303A outputs control command signals to each of the painting robots (first painting robot 1A and second painting robot 1B) of the first painting unit PU1 and the cartridge carrier 400. The second control device 303B outputs control command signals to each of the painting robots 1A, 1B of the second painting unit PU2 and the cartridge carrier 400. The third control device 303C outputs control command signals to each of the painting robots 1A, 1B of the third painting unit PU3 and the cartridge carrier 400. The fourth control device 303D outputs control command signals to each of the painting robots 1A, 1B of the fourth painting unit PU4 and the cartridge carrier 400. The painting robots 1A, 1B in each of the painting units PU1 to PU4 which have received the control command signals paint the vehicle body 150 based on the information on teaching performed in advance. The cartridge carriers 400 which have received the control command signals perform cartridge carrying operation described later.

Operation in Painting

Next, painting operation (painting method) in the painting system PS will be described. Note that the painting operation is performed in an unmanned state in the painting chamber 2.

First, when the start switch 301 is operated, the painting system PS is started up. With the start of the painting system PS, air with regulated temperature and humidity flows from an air conditioner (illustration omitted) into the air supply chamber 3 through the supply duct 7 before the start of painting operation. In the air supply chamber 3, the air volume regulation mechanism 31 regulates the air volume. The regulated air is introduced into the painting chamber 2 through the filter 23 of the inlet 21*a*.

In the painting chamber 2, the air coming from the air supply chamber 3 to the collection chamber 4 is guided to the predetermined region Ri. Thus, a flow (downflow) of air going downward from the inlet 21*a* to the outlet 22*a* is formed in the predetermined region Ri.

Then, the air passes through the predetermined region Ri of the painting chamber 2, and then the air is discharged into the collection chamber 4 through the grid plate 24 of the outlet 22*a*. In the collection chamber 4, the air volume regulation mechanism 42 regulates the air volume. The regulated air is emitted to the outside through the exhaust duct 8.

Next, the carrier 5 operates in response to a command signal from the carrier controller 302. The carrier 5 moves the vehicle body 150 that is a painting target until the vehicle body 150 reaches the predetermined position of the painting booth 100 (position shown in FIG. 1). While the carrier 5 carries the vehicle body 150 at predetermined speed, the painting robots 1A, 1B of the painting units PU1 to PU4 operate to paint the vehicle body 150. The painting robots 1A, 1B are operated based on the command signals from each of the control devices 303A to 303D. As described above, the arrangement positions of the first painting robot 1A and the second painting robot 1B in each of the painting units PU1 to PU4 are set such that the second painting robot 1B is arranged on the upstream side of the first painting robot 1A in the carrying direction of the vehicle body 150. Accordingly, as for the painting operation, the second painting robot 1B starts the painting operation earlier and ends the painting operation earlier than the first painting robot 1A.

In painting of the vehicle body 150, the first painting robot 1A in each of the painting units PU1 to PU4 paints an upper region of the vehicle body 150. The second painting robot 1B in each of the painting units PU1 to PU4 paints a region below the upper region of the vehicle body 150. Specifically, the first painting robots 1A in the first painting unit PU1 and the second painting unit PU2 mainly paint a front half of the roof and the engine hood of the vehicle body 150. The second painting robots 1B in the first painting unit PU1 and the second painting unit PU2 mainly paint the front fender and the front door of the vehicle body 150. The first painting robots 1A in the third painting unit PU3 and the fourth painting unit PU4 mainly paint a rear half of the roof of the vehicle body 150. The second painting robots 1B in the third painting unit PU3 and the fourth painting unit PU4 mainly paint the rear fender and the rear doors of the vehicle body 150. In the painting operation by the painting robots 1A, 1B, while the painting robots 1A, 1B face apportioned regions to be painted, the robot arms 12A, 12B are operated so as to move the spray guns 11A, 11B along predetermined trajectories (predetermined trajectories based on the information on teaching) to paint the vehicle body 150.

More specifically as painting operation, painting by electrostatic atomization method without using shaping air is performed in each of the painting robots 1A, 1B. Specifically, as shown in FIG. 6, while negative high voltage is applied to the rotary head 51 by the voltage generator 54, the rotary head 51 is rotated by an air motor (illustration omitted) while the vehicle body 150 is grounded. The distance between the rotary head 51 and the vehicle body 150 is regulated by the robot arms 12A, 12B. As shown in FIG. 4, the paint in a liquid form is supplied to the paint space S from the paint supply pipe 53, and the paint flows out of the discharge holes 511*a* with centrifugal force.

The paint flowing out of the discharge holes 511*a* flows to the radially outer side along the diffusing surface 51*a* by centrifugal force. The paint flowing along the diffusing surface 51*a* becomes a film shape, and reaches the outer edge portion 51*b*, where the paint is supplied to the groove portions 51*c* (see the FIG. 5). The paint in each of the groove portions 51*c* is separated from the paint in each adjacent groove portion 51*c*. The paint passing through the groove portions 51*c* becomes a thread-shape, and is emitted from the radially outer end of the rotary head 51 (groove portions 51*c* appearing on the outer peripheral surface of the rotary head 51).

The thread-shaped paint P1 emitted from the rotary head 51 is electrostatically atomized to the paint particles P2 as shown in FIG. 6. Electric fields are formed between the rotary head 51 and the vehicle body 150, and negatively charged paint particles P2 are attracted to the vehicle body 150. Accordingly, the paint particles P2 are deposited on the vehicle body 150, and a coating film (illustration omitted) is formed on the surface of the vehicle body 150.

In the painting robots 1A, 1B, the robot arms 12A, 12B move the spray guns 11A, 11B along the surface of the vehicle body 150, while the spray guns 11A, 11B perform painting as shown in FIG. 1. Accordingly, the painting robots 1A, 1B paint their apportioned regions on the surface of the vehicle body 150, respectively. Accordingly, the entire surface of the vehicle body 150 is painted.

At the time of the painting, the paint particles not deposited on the vehicle body 150 (overspray mist) may be generated. The generation range of the overspray mist is included in the predetermined region Ri. Therefore, the overspray mist generated at the time of painting is carried downward by the downflow, and is discharged into the collection chamber 4. In the collection chamber 4, the overspray mist is collected by the filter 41. Thus, the paint particles not deposited on the vehicle body 150 are removed from air with the filter 41, and the air sent out to the exhaust duct 8 is cleaned.

When the entire surface of the vehicle body 150 is painted and the painting operation is completed in this way, the carrier 5 carries out the vehicle body 150 from the painting booth 100, and another vehicle body 150 that is a next target for painting is carried in to the painting booth 100 to perform the same painting operation. When the new vehicle body 150 is painted, there may be a case where the residual amount of the paint cartridges PC loaded into the spray guns 11A, 11B is small, or a case of changing the paint used for painting the vehicle body 150. In these cases, it is necessary to replace the paint cartridges PC to be loaded into the spray guns 11A, 11B. In replacing the paint cartridges PC loaded into the spray guns 11A, 11B, the cartridge carrier 400 carries desired paint cartridges PC from the paint injector 205 to the spray guns 11A, 11B.

As described above, the second painting robot 1B is arranged on the upstream side of the first painting robot 1A in the carrying direction of the vehicle body 150. Hence, as for the painting operation, the second painting robot 1B starts the painting operation and ends the painting operation earlier than the first painting robot 1A. Accordingly, the replacement of the paint cartridges PC loaded into the spray gun 11B of the second painting robot 1B also performs earlier than the replacement of the spray gun 11A of the first painting robot 1A.

Figure 11:
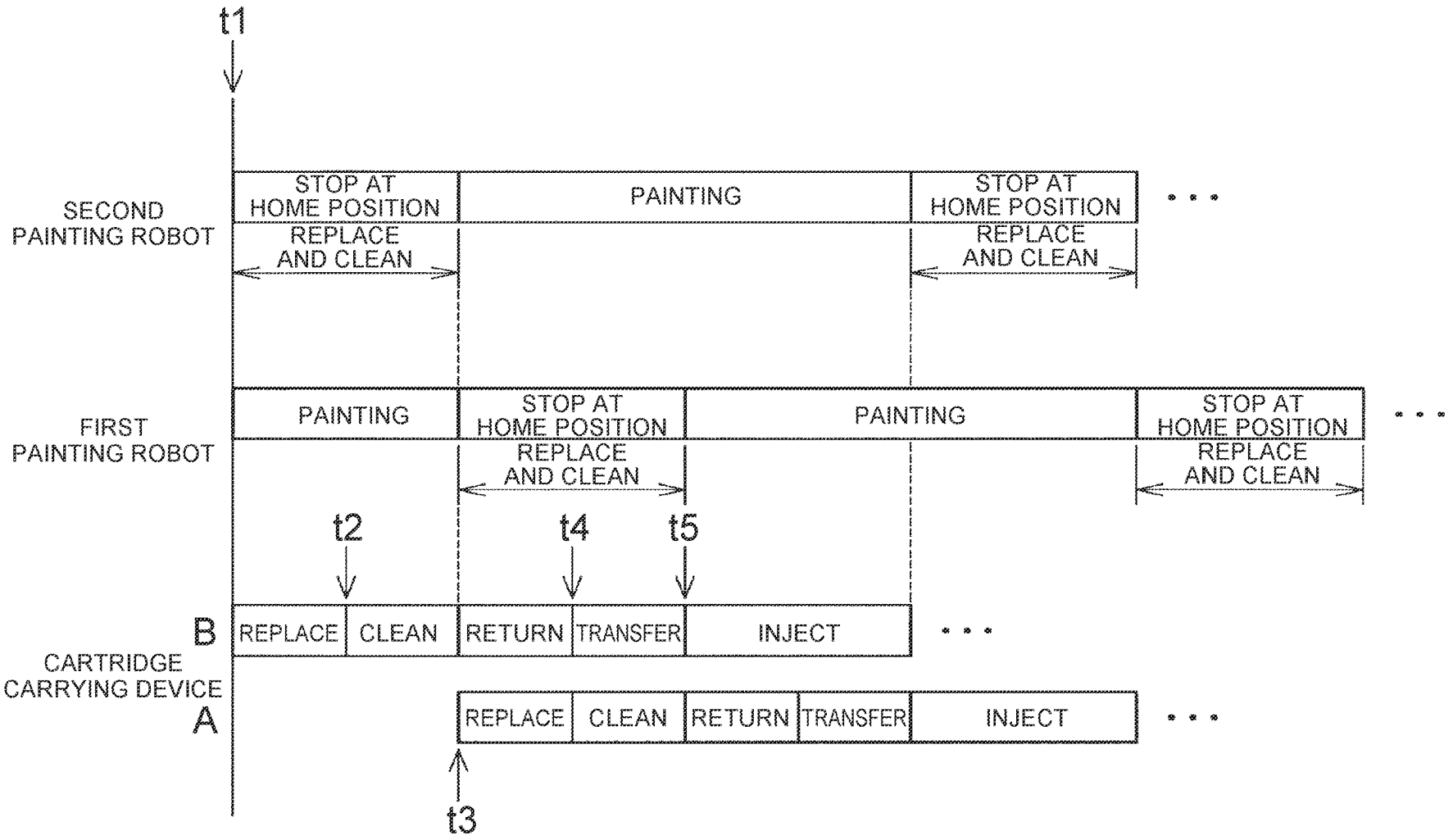
FIG. 11 is a timing chart for illustrating an example of operation of the painting robots and the cartridge carrier.

Hereinafter, description is given of the operation of each of the painting robots 1A, 1B and the cartridge carrier 400 in the replacement operation of the paint cartridges PC loaded into the spray guns 11A, 11B to the painting operation by each of the painting robots 1A, 1B along the timing chart of FIG. 11. The timing chart shown in the FIG. 11 shows the operation of each of the painting robots 1A, 1B and the cartridge carrier 400 after time t1 when the painting operation of the second painting robot 1B is finished. In the operation of the cartridge carrier 400 of FIG. 11, B is an operation targeting the paint cartridge PC attached to and detached from the spray gun 11B of the second painting robot 1B, and A is an operation targeting the paint cartridge PC attached to and detached from the spray gun 11A of the first painting robot 1A.

First, at timing t1 in FIG. 11, the second painting robot 1B ends the painting operation. As the robot arm 12B of the second painting robot 1B operates, the spray gun 11B moves to the third region A3 as a home position. At the time, the first painting robot 1A still continues to perform painting operation. In the state where the spray gun 11B of the second painting robot 1B has moved to the third region A3 as the home position, the cartridge grip part 401 of the cartridge carrier 400 also moves to the third region A3. The cartridge grip part 401 which has moved to the third region A3 operates to replace the paint cartridge PC for the cartridge loading part 55 of the spray gun 11B in the second painting robot 1B. In the replacement operation, the following operations are performed in sequence: detaching the used paint cartridge PC loaded into the spray gun 11B (detaching the paint cartridge PC by using one grip unit 404 (405)); cleaning the paint discharge part 50 of the spray gun 11B (cleaning in the cleaning tank 500); and loading a new paint cartridge PC on the spray gun 11B (loading a paint cartridge PC by using another grip unit 405 (404)). Thus, replacement of the paint cartridges PC and cleaning of the paint discharge part 50 of the spray gun 11B are performed practically at the same timing. As a result, the time from the end of the painting operation to the start of next painting operation can be shortened as compared with the case where replacement of the paint cartridge PC and cleaning of the paint discharge part 50 of the spray gun 11B are performed at different timing.

At timing t2 in FIG. 11, the cartridge grip part 401 of the cartridge carrier 400 carries the used paint cartridge PC to the paint injection part 205*b* of the paint injector 205, and the paint cartridge PC is cleaned in the paint injection part 205*b*.

Thus, in the present embodiment, the painting operation of the first painting robot 1A continues during the period of: replacing the paint cartridge PC for the cartridge loading part 55 of the spray gun 11B in the second painting robot 1B; cleaning the paint discharge part 50 of the spray gun 11B; and cleaning the paint cartridge PC. Similarly, the painting operation of the second painting robot 1B continues during the period of: replacing the paint cartridge PC for the cartridge loading part 55 of the spray gun 11A in the first painting robot 1A; cleaning the paint discharge part 50 of the spray gun 11A; and cleaning the paint cartridge PC. Accordingly, when the painting robots 1A, 1B end painting at the same time, one painting robot 1A needs to wait until the other painting robot 1B ends these operations (replacement operation and cleaning operation). In the present embodiment, since such a situation does not occur, it is possible to effectively perform each operation.

The first painting robot 1A ends the painting operation approximately at the same time (timing t3) when cleaning of the paint cartridge PC is finished. As the robot arm 12A of the first painting robot 1A operates, the spray gun 11A is moved to the third region A3 as the home position. The second painting robot 1B, having the spray gun 11B loaded with a new paint cartridge PC by the cartridge grip part 401, waits for a vehicle body 150, which is the next painting target, to be carried in the painting booth 100, and starts painting operation.

In the state where the spray gun 11A of the first painting robot 1A is moved to the third region A3 as a home position, the cartridge grip part 401 is operated to replace the paint cartridge PC for the cartridge loading part 55 of the spray gun 11A in the first painting robot 1A. In the replacement operation, the following operations are also performed in sequence: detaching the used paint cartridge PC loaded into the spray gun 11A; cleaning the paint discharge part 50 of the spray gun 11A; and loading a new paint cartridge PC into the spray gun 11A.

Meanwhile, the paint cartridge PC that is detached from the spray gun 11B of the second painting robot 1B and cleaned is gripped by the cartridge grip part 401 of the cartridge carrier 400, and carried to the cartridge stocker 205*a* to be collected (returned). Then, the paint cartridge PC collected by the cartridge stocker 205*a* is carried (transferred) to the paint injection part 205*b* as necessary (timing t4 in FIG. 11). In the paint injection part 205*b*, predetermined paint injecting operation is started (timing t5 in FIG. 11). Then, at the time when the paint injecting operation is finished, and then the second painting robot 1B ends painting, the replacement of the paint cartridge PC described above is performed. For the replacement, the paint cartridge PC injected with the paint is gripped by the cartridge grip part 401 of the cartridge carrier 400 and carried to the spray gun 11B of the second painting robot 1B. The same operation is also performed on the first painting robot 1A. Thus, painting by each of the painting robots 1A, 1B, and replacement, cleaning, return, and transfer of the paint cartridge PC, and paint injection into the paint cartridge PC are repeated.

Description is now given of an example of more preferable carrying operation as a carrying operation of the paint cartridge PC using two grip units 404, 405 since the cartridge grip part 401 includes the grip units 404, 405 as described before. FIGS. 12A-12H illustrate an example of the carrying operation of each paint cartridge PC in the cartridge carrier 400. FIGS. 12A-12H show the carrying operation of the paint cartridge PC at and after the start of operation of taking out a paint cartridge PC to be loaded into the spray gun 11B of the second painting robot 1B from the cartridge stocker 205*a*. In FIGS. 12A-12H, reference sign PC2*a* is added to the paint cartridge (used paint cartridge) to be detached from the spray gun 11B of the second painting robot 1B, and reference sign PC2*b* is added to the paint cartridge (new paint cartridge injected with paint) to be newly loaded into the spray gun 11B of the second painting robot 1B. Similarly, reference sign PC1*a* is added to the paint cartridge (used paint cartridge) to be detached from the spray gun 11A of the first painting robot 1A, and reference sign PC1*b* is added to the paint cartridge (new paint cartridge injected with paint) to be newly loaded into the spray gun 11A of the first painting robot 1A.

Figure 12A:
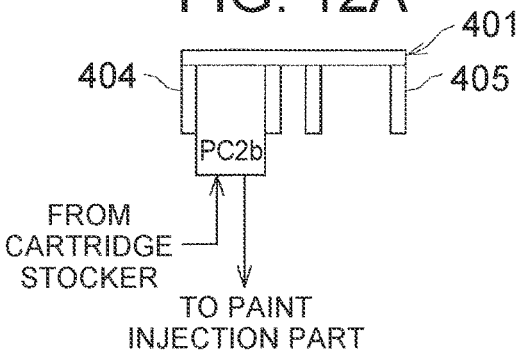
FIG. 12A illustrates an example of carrying operation of each paint cartridge in the cartridge carrier.

First, as shown in FIG. 12A, the first grip unit 404 takes out an empty paint cartridge PC2*b* in a standby state in the cartridge stocker 205*a* from the cartridge stocker 205*a*, and carries it to the paint injection part 205*b*. After the carrying of the paint cartridge PC2*b* is completed, the paint injection part 205*b* starts to inject paint in the paint cartridge PC2*b*. At the time when the operation shown in the FIG. 12A is completed, the first grip unit 404 and the second grip unit 405 do not grip any paint cartridge PC.

Figure 12B:
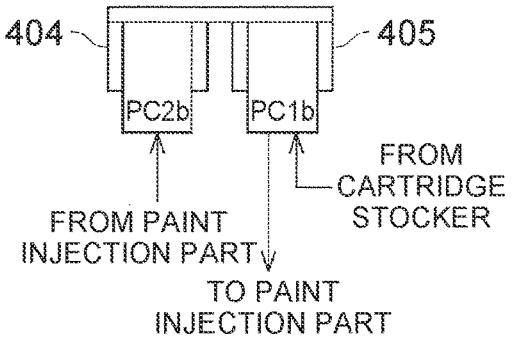
FIG. 12B illustrates an example of carrying operation of each paint cartridge in the cartridge carrier.

Then, as shown in FIG. 12B, the second grip unit 405 takes out the paint cartridge PC1*b* in a standby state in the cartridge stocker 205*a* from the cartridge stocker 205*a*, and carries it to the paint injection part 205*b*. After the carrying of the paint cartridge PC2*b* is completed, the paint injection part 205*b* starts to inject paint in the paint cartridge PC1*b*. At approximately the same time, the first grip unit 404 takes out the paint cartridge PC2*b* in which injection of paint is completed (paint cartridge PC2*b* in which the paint injection operation is started at the timing of FIG. 12A) from the paint injection part 205*b*. At the time when the operation shown in the FIG. 12B is completed, the first grip unit 404 grips the paint cartridge PC2*b*, and the second grip unit 405 does not grip any paint cartridge PC.

Figure 12C:
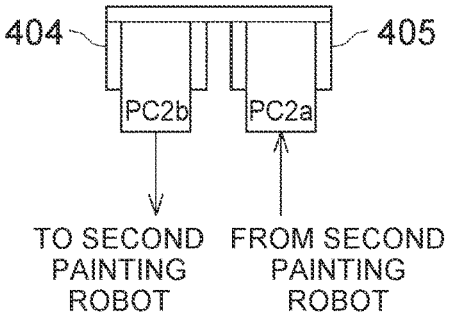
FIG. 12C illustrates an example of carrying operation of each paint cartridge in the cartridge carrier.

Then, the cartridge grip part 401 is carried to the vicinity of the spray gun 11B of the second painting robot 1B. As shown in FIG. 12C, the second grip unit 405 detaches the used paint cartridge PC2*a* from the spray gun 11B of the second painting robot 1B. Then, the first grip unit 404 loads the paint cartridge PC2*b* into the spray gun 11B of the second painting robot 1B. Hence, replacement of the paint cartridge PC for the spray gun 11B of the second painting robot 1B is completed. During the replacement operation, cleaning of the paint discharge part 50 of the spray gun 11B is performed as described before. At the time when the operation shown in the FIG. 12C is completed, the first grip unit 404 does not grip any paint cartridge PC, and the second grip unit 405 grips the paint cartridge PC2*a*.

Figure 12D:
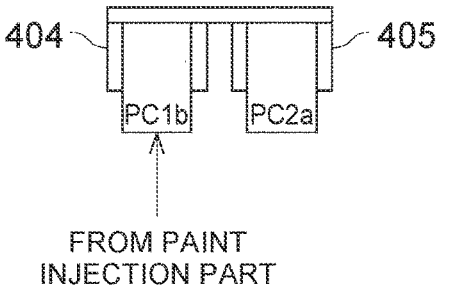
FIG. 12D illustrates an example of carrying operation of each paint cartridge in the cartridge carrier.

Then, the cartridge grip part 401 is carried to the vicinity of the paint injection part 205*b* of the paint injector 205. As shown in FIG. 12D, the first grip unit 404 takes out the paint cartridge PC1*b* for which injection of paint is completed (paint cartridge PC1*b* for which paint injecting operation is started at the timing of FIG. 12B) from the paint injection part 205*b*. At the time when the operation shown in the FIG. 12D is completed, the first grip unit 404 grips the paint cartridge PC1*b*, and the second grip unit 405 grips the paint cartridge PC2*a*.

Figure 12E:
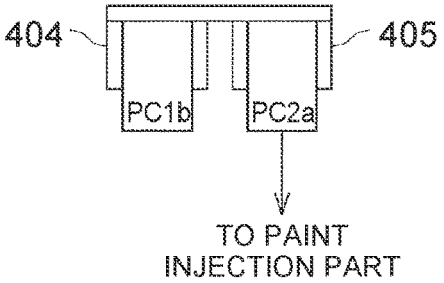
FIG. 12E illustrates an example of carrying operation of each paint cartridge in the cartridge carrier.

Then, as shown in FIG. 12E, the second grip unit 405 carries the gripped paint cartridge PC2*a* to the paint injection part 205*b* to clean the paint cartridge PC2*a*. After the carrying of the cartridge PC2*a* is completed, the paint injection part 205*b* starts cleaning operation of the paint cartridge PC2*a*. At the time when the operation shown in the FIG. 12E is completed, the first grip unit 404 grips the paint cartridge PC1*b*, and the second grip unit 405 does not grip any paint cartridge PC.

Figure 12F:
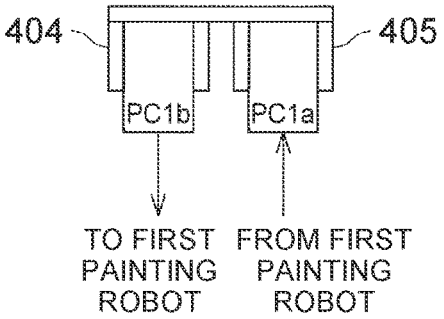
FIG. 12F illustrates an example of carrying operation of each paint cartridge in the cartridge carrier.

Then, the cartridge grip part 401 is carried to the vicinity of the spray gun 11A of the first painting robot 1A. As shown in FIG. 12F, the second grip unit 405 detaches the used paint cartridge PC1*a* from the spray gun 11A of the first painting robot 1A. Then, the first grip unit 404 loads the paint cartridge PC1*b* into the spray gun 11A of the first painting robot 1A. Thus, replacement of the paint cartridge PC for the spray gun 11A of the first painting robot 1A is completed. During the replacement operation, cleaning of the paint discharge part 50 of the spray gun 11A is performed as described before. At the time when the operation shown in the FIG. 12F is completed, the first grip unit 404 does not grip any paint cartridge PC, and the second grip unit 405 grips the paint cartridge PC1*a*.

Figure 12G:
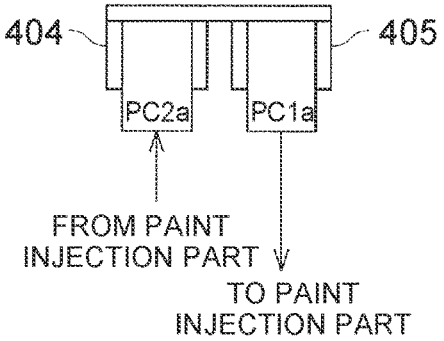
FIG. 12G illustrates an example of carrying operation of each paint cartridge in the cartridge carrier.

Then, the cartridge grip part 401 is carried to the vicinity of the paint injection part 205*b* of the paint injector 205. As shown in FIG. 12G, the first grip unit 404 takes out the cartridge PC2*a* for which cleaning is completed (paint cartridge PC2*a* for which cleaning is started at the timing of FIG. 12E) from the paint injection part 205*b*. The second grip unit 405 carries the gripped paint cartridge PC1*a* to the paint injection part 205*b* to clean the paint cartridge PC1*a*. After the carrying of the paint cartridge PC1*a* is completed, the paint injection part 205*b* starts cleaning operation of the paint cartridge PC1*a*. At the time when the operation shown in the FIG. 12G is completed, the first grip unit 404 grips the paint cartridge PC2*a*, and the second grip unit 405 does not grip any paint cartridge PC.

Figure 12H:
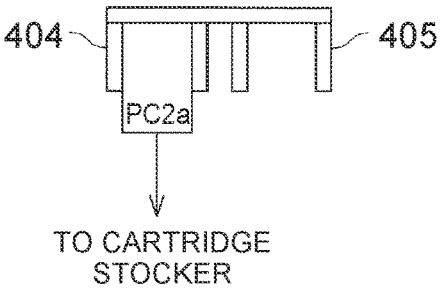
FIG. 12H illustrates an example of carrying operation of each paint cartridge in the cartridge carrier.

Then, as shown in FIG. 12H, the first grip unit 404 carries the gripped paint cartridge PC2*a* to the cartridge stocker 205*a*. At the time when the operation shown in the FIG. 12H is completed, the first grip unit 404 and the second grip unit 405 do not grip any paint cartridge PC.

Thus, performing the carrying operation of the paint cartridge PC by using the two grip units 404, 405 eliminates waiting time that is for waiting the end of the operation such as injecting paint in the paint cartridge PC or cleaning the paint cartridge PC. For example, in the operation of FIG. 12B, during the time when paint is injected to the paint cartridge PC2*b*, the operation of taking out the paint cartridge PC1*b* from the cartridge stocker 205*a* is performed. For example, in the operation of FIG. 12F, during the time when the paint cartridge PC2*a* is cleaned, the replacement operation of the paint cartridges PC1*a*, PC1*b* is performed for the spray gun 11A of the first painting robot 1A. Therefore, it is possible to reduce the loss time in the carrying operation of the paint cartridge PC.

Effects of Embodiments

As described above, according to the present embodiment, the cleaning tank 500 that cleans each of the paint discharge parts 50 of the spray guns 11A, 11B of the first painting robot 1A and the second painting robot 1B which constitute the painting unit PU1 (PU2, PU3, PU4) is arranged at the position where the paint discharge part 50 of the spray gun 11A of the first painting robot 1A can be cleaned and where the paint discharge part 50 of the spray gun 11B of the second painting robot 1B can also be cleaned. Therefore, simply arranging the single cleaning tank 500 makes it possible to clean the paint discharge parts 50 of the painting robots 1A, 1B, and to reduce the number of parts count of the painting system PS.

In the present embodiment in particular, the first region (the region where a part of the movable region Aa of the spray gun 11A of the first painting robot 1A overlaps with a part of the movable region Ac of the cartridge grip part 401 of the cartridge carrier 400) A1 and the second region (the region where a part of the movable region Ab of the spray gun 11B of the second painting robot 1B overlaps with a part of the movable region Ac of the cartridge grip part 401 of the cartridge carrier 400) A2 overlap in the third region A3. The cleaning tank 500 is arranged in the third region A3. When the first region and the second region do not overlap, a large cleaning tank disposed over the first region and the second region is needed to achieve cleaning of the paint discharge parts in a plurality of painting robots with only a single cleaning tank. However, as in the present embodiment, when the first region A1 and the second region A2 overlap in the third region A3, and the cleaning tank 500 is disposed in the third region A3, downsizing of the cleaning tank 500 can be achieved. Since the third region A3 where the cleaning tank 500 is arranged is located between the first painting robot 1A and the second painting robot 1B, interference of the painting robots 1A, 1B (robot arms 12A, 12B) can be suppressed when the paint discharge parts 50 of the spray guns 11A, 11B in the painting robots 1A, 1B are cleaned. As described before, the third region A3 is set to a position closer to the reference plane L than the position of the support 14B of the second painting robot 1B (the position of the support 14B of the second painting robot 1B arranged at the position farther from the reference plane L, out of the painting robots 1A, 1B). Hence, it is possible to reduce the moving distance at the time of moving the paint discharge part 50 of the spray gun 11B in the second painting robot 1B to the cleaning tank 500. This also makes it possible to suppress the interference between the painting robots 1A, 1B (the robot arms 12A, 12B).

In the present embodiment, the paint injector 205 is arranged within the movable region of the cartridge grip part 401 of the cartridge carrier 400. Accordingly, the cartridge carrier 400 can carry the paint cartridge PC that is detached from the cartridge loading part 55 to the paint injector 205, while the cartridge grip part 401 of the cartridge carrier 400 grips the paint cartridge PC. In other words, it becomes possible to carry the paint cartridge PC that is detached from the cartridge loading part 55 to the paint injector 205 without changing the carrier of the paint cartridge PC (without going through other devices). Therefore, the time from detachment of the paint cartridge PC to supply of the paint cartridge PC to the paint injector 205 can be shortened. Since other devices (devices for changing the carrier of the paint cartridge detached from the cartridge loading part) are not required, the painting system PS can be downsized.

In the present embodiment, the movable region of the cartridge grip part 401 of the cartridge carrier 400 is set as a region over the paint injector 205, the first region A1, and the second region A2. Accordingly, one device can perform the functions of both the cartridge carrier 400 for carrying the paint cartridge PC detached from the cartridge loading part 55 of the first painting robot 1A in the first region A1 to the paint injector 205, and the cartridge carrier 400 for carrying the paint cartridge PC detached from the cartridge loading part 55 of the second painting robot 1B in the second region A2 to the paint injector 205. In other words, simply arranging a single cartridge carrier 400 makes it possible to detach the paint cartridge PC from the cartridge loading part 55 and carry the paint cartridge PC to the paint injector 205 for a plurality of painting robots (the first painting robot 1A and the second painting robot 1B). In short, it is possible to implement the configuration in which a single cartridge carrier 400 is arranged for the painting robots 1A, 1B. This also allows reduction in number of parts count of the painting system PS, and thereby reduced production man hours and decreased equipment cost of the painting system PS can be achieved.

Since the configuration in which the first region A1 and the second region A2 overlap in the third region A3 as described above is adopted in particular, both the first painting robot 1A and the second painting robot 1B can perform, with the cartridge grip part 401 of the single cartridge carrier 400, the attaching and detaching operation of the paint cartridge PC to and from the cartridge loading parts 55 of the spray guns 11A, 11B in the third region A3. Specifically, it is possible to perform the attaching and detaching operation of the paint cartridge PC to and from the cartridge loading part 55 of the spray gun 11A in the first painting robot 1A and the attaching and detaching operation of the paint cartridge PC to and from the cartridge loading part 55 of the spray gun 11B in the second painting robot 1B practically at the same position. It is also possible to eliminate the necessity of making a large movement of the cartridge grip part 401 of the cartridge carrier 400 in accordance with the target painting robots 1A, 1B (that are made to attach or detach the paint cartridge PC). In the case of successively performing the attaching and detaching operation of the paint cartridge PC to and from the cartridge loading parts 55 of the spray guns 11A, 11B in the painting robots 1A, 1B, it is also possible to reduce a moving distance of the cartridge grip part 401 of the cartridge carrier 400, and thereby working time can be shortened.

In the present embodiment, the cartridge grip part 401 includes the two grip units 404, 405 that can individually switch between the grip state and the grip release state of the paint cartridge PC. Consequently, in replacing the paint cartridges PC loaded into the cartridge loading parts 55 of the spray guns 11A, 11B in the painting robots 1A, 1B, the cartridge grip part 401 of the cartridge carrier 400 is moved to the vicinity of the cartridge loading part 55 of the spray gun 11A in the state where one grip unit 404 grips an unused paint cartridge (paint cartridge injected with the paint) PC. In this state, it is possible to successively perform detaching the paint cartridge (used paint cartridge) PS from the cartridge loading part 55 using the other grip unit 405, and loading the unused paint cartridge PC into the cartridge loading part 55 using the grip unit 404 that grips the unused paint cartridge PC. In the case where only one grip unit is provided, it is necessary to perform such operation as carrying the paint cartridge after it is detached (carrying the detached paint cartridge to a cartridge stocker which collects the paint cartridges, or the like), then going to a waiting place of the paint cartridges (for example, a paint injection part) to fetch an unused paint cartridge, and carrying the fetched paint cartridge to the cartridge loading part of the spray gun. However, according to the present embodiment, these operations become unnecessary. Therefore, the replacement operation of the paint cartridges PC can be simplified, and required time can be shortened.

The painting system PS according to the present embodiment has the configuration in which a plurality of painting units PU1 to PU4 are arranged on both the sides of the reference plane L. Accordingly, in the vehicle body 150, it becomes possible to satisfactorily paint the region of one side and the region of the other side with respect to the reference plane L by each of the painting robots 1A, 1B of the painting units PU1 to PU4. Therefore, the painted surface of the vehicle body 150 can satisfactorily be finished.

In the present embodiment, the spray guns 11A, 11B electrostatically atomize the paint, and spray the atomized paint to the vehicle body 150. Accordingly, the deposition efficiency of the paint to the vehicle body 150 can be improved, and the range where the paint sprayed to the vehicle body 150 rebounds can be reduced. Hence, it becomes unnecessary to arrange the painting robots 1A, 1B at the positions further away from the vehicle body 150 in order to prevent the rebounding paint from adhering to the painting robots 1A, 1B. Therefore, it becomes possible to set the arrangement positions of the painting robots 1A, 1B to the positions close to the vehicle body 150. As a result, it is possible to shorten the length of the painting system PS in the width direction to downsize the painting system PS, and to thereby contribute to decreased equipment cost or running cost. Downsizing of the painting system PS can also provide a $CO_2$ reducing effect.

Second Embodiment

Next, a second embodiment will be described. The present embodiment is different from the first embodiment in the arrangement form of the painting robots 1A, 1B in each of the painting units PU1 to PU4.

Figure 13:
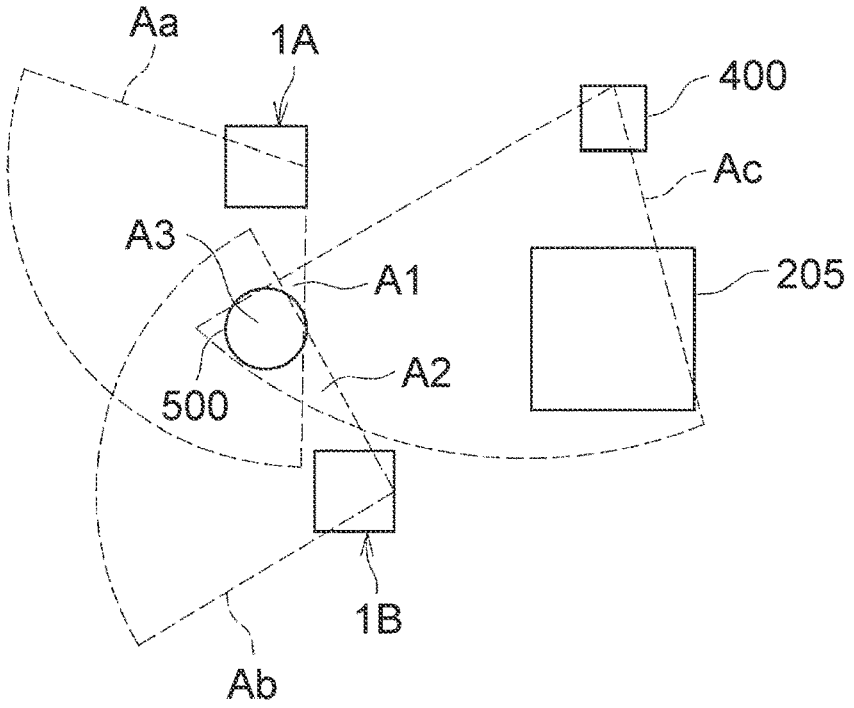
FIG. 13 is a plan view schematically showing movable regions of the spray guns moved by the robot arms of the painting robots in the first painting unit and the movable region of the cartridge grip part moved by the robot arm of the cartridge carrier in a second embodiment.

FIG. 13 is a plan view schematically showing the movable regions of the spray guns 11A, 11B moved by the robot arms 12A, 12B of the painting robots 1A, 1B in the first painting unit PU1, and the movable region of the cartridge grip part 401 moved by the robot arm 402 of the cartridge carrier 400 in the present embodiment. As shown in the FIG. 13, in each of the painting unit PU1 (PU2 to PU4) in the painting system PS according to the present embodiment, the arrangement positions of the first painting robot 1A and the second painting robot 1B are set such that the first painting robot 1A is arranged on the upstream side of the second painting robot 1B in the carrying direction of the vehicle body 150.

As in the case of the first embodiment, a part of the movable region Aa of the spray gun 11A of the first painting robot 1A overlaps with a part of the movable region Ac of the cartridge grip part 401 of the cartridge carrier 400 in the first region A1. Moreover, a part of the movable region Ab of the spray gun 11B of the second painting robot 1B overlaps with a part of the movable region Ac of the cartridge grip part 401 of the cartridge carrier 400 in the second region A2. Furthermore, a part of the first region A1 and a part of the second regions A2 overlap in the third region A3. The cleaning tank 500 is arranged at the third region A3.

Therefore, in the present embodiment, as in the case of the first embodiment, simply arranging the single cleaning tank 500 makes it possible to clean the paint discharge parts 50 of the painting robots 1A, 1B, and to reduce the number of parts count of the painting system PS.

Third Embodiment

Next, a third embodiment will be described. The present embodiment is also different from the first embodiment in the arrangement form of the painting robots 1A, 1B in each of the painting units PU1 to PU4.

Figure 14:
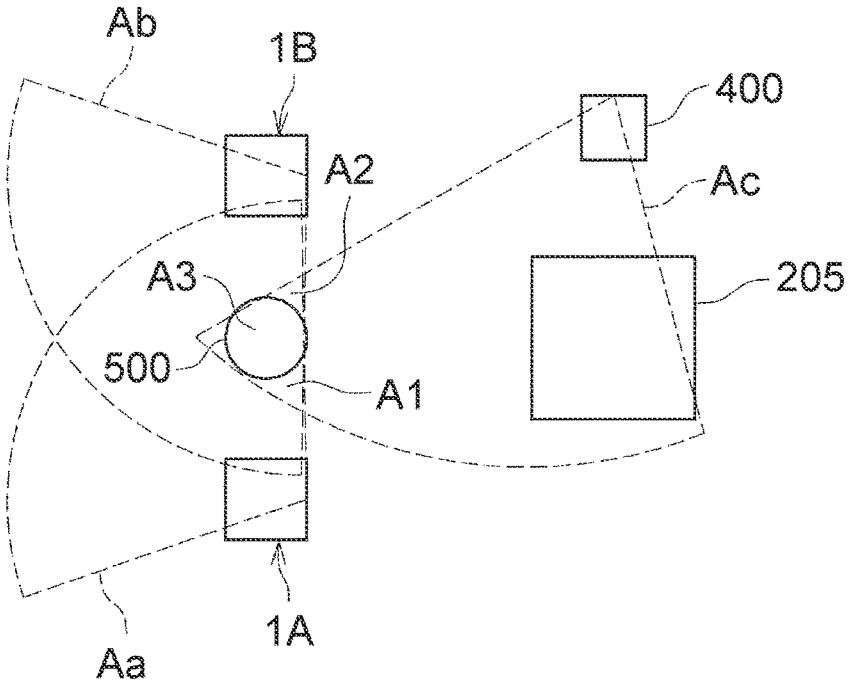
FIG. 14 is a plan view schematically showing movable regions of the spray guns moved by the robot arms of the painting robots in the first painting unit and the movable region of the cartridge grip part moved by the robot arm of the cartridge carrier in a third embodiment.

FIG. 14 is a plan view schematically showing the movable regions of the spray guns 11A, 11B by the robot arms 12A, 12B of the painting robots 1A, 1B in the first painting unit PU1, and the movable region of the cartridge grip part 401 by the robot arm 402 of the cartridge carrier 400 in the present embodiment. As shown in the FIG. 14, in each of the painting unit PU1 (PU2 to PU4) in the painting system PS according to the present embodiment, the arrangement positions of the first painting robot 1A and the second painting robot 1B are set such that the first painting robot 1A is arranged on the downstream side of the second painting robot 1B in the carrying direction of the vehicle body 150, and the painting robots 1A, 1B are arranged to be in the same distance to the reference plane L.

As in the case of the first embodiment, a part of the movable region Aa of the spray gun 11A of the first painting robot 1A overlaps with a part of the movable region Ac of the cartridge grip part 401 of the cartridge carrier 400 in the first region A1. Moreover, a part of the movable region Ab of the spray gun 11B of the second painting robot 1B overlaps with a part of the movable region Ac of the cartridge grip part 401 of the cartridge carrier 400 in the second region A2. Furthermore, a part of the first region A1 and a part of the second regions A2 overlap in the third region A3. The cleaning tank 500 is arranged at the third region A3.

Therefore, in the present embodiment, as in the case of the first embodiment, simply arranging the single cleaning tank 500 makes it possible to clean the paint discharge parts 50 of the painting robots 1A, 1B, and to reduce the number of parts count of the painting system PS.

Fourth Embodiment

Next, a fourth embodiment will be described. The present embodiment is different from the first embodiment in the arrangement form of the painting robots 1A, 1B in each of the painting units PU1 to PU4.

Figure 15:
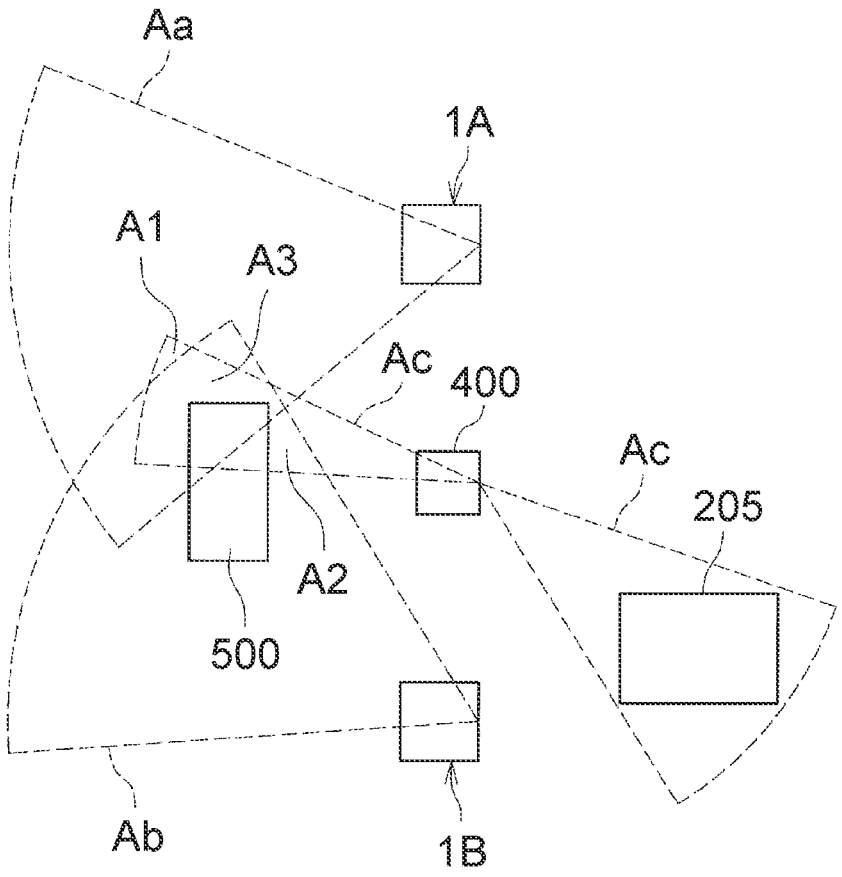
FIG. 15 is a front view schematically showing movable regions of the spray guns moved by the robot arms of the painting robots in the first painting unit and the movable region of the cartridge grip part moved by the robot arm of the cartridge carrier in a fourth embodiment.

FIG. 15 is a front view schematically showing the movable regions of the spray guns 11A, 11B by the robot arms 12A, 12B of the painting robots 1A, 1B in the first painting unit PU1, and the movable region of the cartridge grip part 401 by the robot arm 402 of the cartridge carrier 400 in the present embodiment. As shown in the FIG. 15, in each of the painting unit PU1 (PU2 to PU4) in the painting system PS according to the present embodiment, the arrangement positions of the first painting robot 1A and the second painting robot 1B are set such that the first painting robot 1A and the second painting robot 1B are juxtaposed in an up-down direction. Specifically, the painting robots 1A, 1B are arranged in the same distance to the reference plane L, and arranged at the same position in the length direction of the painting system PS (carrying direction of the vehicle body 150).

As in the case of the first embodiment, a part of the movable region Aa of the spray gun 11A of the first painting robot 1A overlaps with a part of the movable region Ac of the cartridge grip part 401 of the cartridge carrier 400 in the first region A1. Moreover, a part of the movable region Ab of the spray gun 11B of the second painting robot 1B overlaps with a part of the movable region Ac of the cartridge grip part 401 of the cartridge carrier 400 in the second region A2. Furthermore, a part of the first region A1 and a part of the second regions A2 overlap in the third region A3. The cleaning tank 500 is arranged at the third region A3.

Therefore, in the present embodiment, as in the case of the first embodiment, simply arranging the single cleaning tank 500 makes it possible to clean the paint discharge parts 50 of the painting robots 1A, 1B, and to reduce the number of parts count of the painting system PS.

Other Embodiments

The present disclosure is not limited to the embodiments disclosed. Modifications and applications embraced in the range of the claims and the range of equivalency thereof are possible.

For example, although the article to be painted is the vehicle body 150 in the example shown in each of the embodiments, the present disclosure is applicable to the case where the article to be painted is other than the vehicle body 150.

Although the painting system PS including eight painting robots 1A, 1B is used as an example for describing each of the embodiments, the number of the painting robots 1A, 1B is not limited to this. Although the case where one painting unit PU1 (PU2, PU3, PU4) includes two painting robots 1A, 1B has been described in each of the embodiments, one painting unit PU1 (PU2, PU3, PU4) may include three or more painting robots. Also in this case, at least two painting robots out of three or more painting robots which constitute the painting unit PU1 (PU2, PU3, PU4) have the relationship according to the present disclosure (configuration in which the single cleaning tank 500 can clean the paint discharge parts of the spray guns 11A, 11B of the painting robots 1A, 1B).

Each of the embodiments also adopts the configuration in which the first painting robot 1A in the first painting unit PU1 faces the first painting robot 1A in the second painting unit PU2 across the passing region Rp, and the second painting robot 1B in the first painting unit PU1 faces the second painting robot 1B in the second painting unit PU2 across the passing region Rp. Similarly, each of the embodiments adopts the configuration in which the first painting robot 1A in the third painting unit PU3 faces the first painting robot 1A in the fourth painting unit PU4 across the passing region Rp, and the second painting robot 1B in the third painting unit PU3 also faces the second painting robot 1B in the fourth painting unit PU4 across the passing region Rp. Without being limited thereto, the present disclosure may have configuration in which the first painting robots 1A do not face each other across the passing region Rp, and configuration in which the second painting robots 1B do not face each other across the passing region Rp. For example, the present disclosure may have configuration in which the first painting unit PU1 and the third painting unit PU3 have the layout used in the first embodiment (the layout in which the first painting robot 1A is arranged on the downstream side of the second painting robot 1B in the carrying direction of the vehicle body 150 as in FIG. 1), and the second painting unit PU2 and the fourth painting unit PU4 may have the layout used in the second embodiment (the layout in which the first painting robot 1A is arranged on the upstream side of the second painting robot 1B in the carrying direction of the vehicle body 150 as in FIG. 13). The present disclosure may also have configuration in which the first painting unit PU1 and the third painting unit PU3 has the layout used in the second embodiment, and the second painting unit PU2 and the fourth painting unit PU4 has the layout used in the first embodiment. According to these configurations, it is possible to reduce the possibility that the first painting robots 1A may interfere with each other when they paint a central portion of the roof, or the like.

In each of the embodiments, paint may be aqueous paint, or may be solvent-based paint.

In each of the embodiments, the amount of paint injected into the paint cartridge PC in the paint injection part 205*b* of the paint injector 205 may be the amount for filling the inside of the paint cartridge PC, or may be a predefined adequate amount for painting the vehicle body 150.

In each of the embodiments, one cartridge carrier 400 and one paint injector 205, as well as one cleaning tank 500, are arranged for each of the painting units PU1 to PU4. However, the configuration of arranging one cartridge carrier 400 and one paint injector 205 for each of the painting robots 1A, 1B is also within the technical idea of the present disclosure.

In description of each of the embodiments, the article to be painted is painted by spraying the paint from the spray guns 11A, 11B. However, the present disclosure is also applicable to painting systems that paint the article to be painted with techniques other than spraying.

The present disclosure is applicable to the painting system including the painting units having a plurality of painting robots.

What is claimed is:

1. A painting system, comprising:

a painting unit configured to move relatively to an article to be painted, the painting unit including a first painting robot and a second painting robot, each of the first painting robot and the second painting robot including a robot arm, each of the robot arms including a painting machine, the painting machine including a cartridge loading part and a paint discharge part, the cartridge loading part being configured to be loaded with a paint cartridge, the paint discharge part being configured to discharge paint supplied from the paint cartridge toward the article to be painted;

a cartridge carrier configured to carry the paint cartridge and load the paint cartridge into the cartridge loading part, the cartridge carrier including a cartridge grip part being configured to grip the paint cartridge; and a single cleaning tank configured to clean the paint discharge parts of the painting machines in the first painting robot and in the second painting robot, wherein:

the first painting robot and the cartridge carrier are disposed such that a movable region of the painting machine of the first painting robot and a movable region of the cartridge grip part each include a first region where the movable region of the painting machine of the first painting robot overlaps with the movable region of the cartridge grip part;

the second painting robot and the cartridge carrier are disposed such that a movable region of the painting machine of the second painting robot and the movable region of the cartridge grip part each include a second region where the movable region of the painting machine of the second painting robot overlaps with the movable region of the cartridge grip part;

the first region and the second region overlap in a third region; and the single cleaning tank is disposed in the third region.

2. The painting system according to claim 1, wherein the painting unit is configured to move relatively to the article to be painted in a horizontal direction, and when a virtual plane extending along a route that the article to be painted moves relatively and extending in a vertical direction is defined as a reference plane, the first painting robot is configured to be disposed on a side same as a side of the second painting robot with respect to the reference plane.

3. The painting system according to claim 1, further comprising a paint injector configured to inject the paint into the paint cartridge, the paint injector being disposed in the movable region of the cartridge grip part of the cartridge carrier.

4. The painting system according to claim 3, wherein the movable region of the cartridge grip part of the cartridge carrier is set as a region over the paint injector, the first region, and the second region.

5. The painting system according to claim 1, wherein the cartridge grip part of the cartridge carrier is provided with a plurality of grip units configured to individually switch between a grip state and a grip release state of the paint cartridge.

6. The painting system according to claim 1, wherein at least one of the paint discharge part of the first painting robot or the paint discharge part of the second painting robot is configured to electrostatically atomize the paint and discharge the atomized paint toward the article to be painted.

7. The painting system according to claim 1, wherein:

the painting unit is configured to move relatively to the article to be painted in a horizontal direction;

when a virtual plane extending along a route that the article to be painted moves relatively and extending in a vertical direction is defined as a reference plane, the painting unit is disposed on both sides of the reference plane;

the first painting robot and the second painting robot in the painting unit disposed on one side with respect to the reference plane are each configured to paint a surface on the one side of the article to be painted; and the first painting robot and the second painting robot in the painting unit disposed on the other side with respect to the reference plane are each configured to paint a surface on the other side of the article to be painted.

8. The painting system according to claim 1, wherein:

the first painting robot is configured to paint an upper region of the article to be painted; and the second painting robot is configured to paint a lower region of the article to be painted.

9. A method of painting using the painting system according to claim 1, the method comprising:

painting the article to be painted with the paint that is discharged from the first painting robot and the second painting robot, while the article to be painted and the painting unit move relatively;

cleaning the paint discharge part of the painting machine of the first painting robot with the single cleaning tank in the first region after painting operation by the first painting robot is finished; and cleaning the paint discharge part of the painting machine of the second painting robot with the single cleaning tank in the second region after painting operation by the second painting robot is finished.

* * * * *